US005894702A

United States Patent [19]

Stenekes

[11] Patent Number: 5,894,702

[45] Date of Patent: Apr. 20, 1999

[54] INTERLOCKING BUILDING BLOCK

[75] Inventor: Simon Stenekes, Burlington, Canada

[73] Assignee: NewTec Building Products Inc., Burlington, Canada

[21] Appl. No.: 08/850,105

[22] Filed: May 1, 1997

[51] Int. Cl.[6] ..... E04C 1/39

[52] U.S. Cl. ..... 52/606; 52/604; 52/592.1; 52/592.6

[58] Field of Search ..... 52/606, 607, 604, 52/426, 431, 592.1, 592.6

[56] References Cited

U.S. PATENT DOCUMENTS

| | | | |
|---|---|---|---|
| 945,859 | 1/1910 | Neuberger . | |
| 2,205,419 | 6/1940 | Kraemer | 52/606 |
| 2,688,245 | 9/1954 | Vesper . | |
| 2,703,487 | 3/1955 | Ossoinack . | |
| 3,888,060 | 6/1975 | Haener . | |
| 4,107,894 | 8/1978 | Mullins . | |
| 4,319,440 | 3/1982 | Rassias et al. | 52/607 X |
| 4,372,091 | 2/1983 | Brown et al. . | |
| 4,514,949 | 5/1985 | Crespo | 52/607 X |
| 4,640,071 | 2/1987 | Haener . | |

FOREIGN PATENT DOCUMENTS

| | | |
|---|---|---|
| 841 339 | 6/1952 | Germany . |
| 391 242 | 8/1965 | Switzerland . |

*Primary Examiner*—Christopher Kent

[57] ABSTRACT

Interlocking building blocks of varying widths having projections and recesses positioned to allow the blocks to be staggered by one-half the length of a block in vertically adjacent blocks so as to form complex architectural features, including corners and T-walls. The blocks overlap at the ends and have L-shaped profiles so that the block's inner and outer faces are interchangeable. Reinforcement bars are accommodated in grooves disposed on a bottom surface of the blocks so as to be adjacent to wall openings for windows, doors and the like.

20 Claims, 29 Drawing Sheets

INTERLOCKING BUILDING BLOCK

FIELD OF THE INVENTION

This invention relates to an interlocking building block for use in the construction of mortarless walls.

BACKGROUND OF THE INVENTION

Interlocking building blocks used in the construction of mortarless walls typically have projections on an upper surface of the block and have corresponding recesses on a lower surface of the block, the projections of one block being adapted to be received in, and interlock with, the recesses of an overlying block, thereby obviating the need for any securing mortar between courses. Such blocks may be used to construct building structures and are also used with increasing popularity in developing countries to reduce the building costs by decreasing the time required to complete a structure. Walls made from interlocking blocks are also gaining acceptance in zones having seismic activity.

Commonly, vertically adjacent blocks are staggered by one-half the length of a block to construct a wall or other architectural structure. Conveniently, the blocks used in masonry have a length to width ratio of 2:1 so that, when a first block is disposed transversely to a second block, such as at a corner, the first block occupies only half the length of the second block and the modular relationship between overlying blocks is not altered, thereby maintaining a uniform and aesthetic appearance. This relationship between the length and width is particularly important in interlocking blocks where the projections and recesses are in predefined positions on the blocks and there is no flexibility for adjusting the relative position of superimposed blocks.

In some circumstances, it is desirable to construct walls where the modular length of one block is maintained, but in which the thickness of the wall is varied. One might, for example, construct exterior walls of a structure which are relatively thicker than interior walls. While the length of the blocks used to construct a thick wall could be increased to be commensurate with an increased block width and to maintain the length-to-width ratio of 2:1, this is often not a practical solution. Such blocks are generally too bulky for handling and architects and masons become accustomed to making calculations based on a standard modular length unit. Typically, a modular length unit for a block is 400 mm and the associated width is 200 mm.

One problem which is addressed by this invention is to provide an interlocking building block in which a modular relationship can be maintained with blocks of varying widths, thus giving the builder more flexibility to construct a variety of architectural features, including walls which intersect to form partitions and corners.

The invention also has advantageous features for interlocking blocks disposed side-by-side in a course and for accommodating reinforcement bars traversing the length of a block and which link the blocks of a course together to strengthen the structure, as will be described in more detail below.

SUMMARY OF THE INVENTION

In accordance with one aspect of this invention, there is provided an interlocking building block for use in constructing mortarless walls, the building block having an outer face in spaced parallel relationship with an inner face, the outer and inner face each having a nominal predetermined length ¾ x between respective ends and the width of the block between said faces being ¼ x where x corresponds to one modular length unit. Two sets of at least one projection are integrally formed in an operatively upper surface of the block and a corresponding number of recesses are integrally formed in an operatively lower surface of the block, the recesses being adapted to receive the projections of an underlying block. The projections of one set are spaced from one end of the block by a distance ¼ x, and the projections of the other set are spaced from the other end of the block by a distance ⅛ x.

The above-mentioned ¾ block is adapted to cooperate with blocks having a nominal predetermined length of ½ x to form architectural features. The ½ blocks are characterized by projections centered on a line spaced from one end of the faces by a distance ⅛ x.

For other length-to-width ratios, the preselected position of the projections and recesses is varied accordingly and is centered on a line spaced from one end of the block by a distance which is half the width of the block for selected blocks having a nominal predetermined length which is either a whole modular length unit x or a fractional modular length such as ½ x or ¼ x or ⅛ x.

In accordance with another aspect of the invention, the block has inner and outer face shells in spaced parallel relationship and the ends of the face shells each have an L-shaped profile of the same orientation at respective ends of the block and a complementary orientation at an opposite end of the block. This allows the ends of a block to cooperate and interlock with the ends of adjacent blocks of which the outer face shells and inner face shells may be disposed on either side of a wall being constructed.

In accordance with yet another aspect of the invention, transversely disposed bridge portions extend between outer and inner face shells and the bridge portions are grooved to define a chase for a reinforcement bar on the operatively lower surface of the bridge portions.

BRIEF DESCRIPTION OF THE DRAWINGS

These aspects of the invention are more fully described below with reference to the accompanying drawings, in which.

DESCRIPTION OF PREFERRED EMBODIMENT WITH REFERENCE TO DRAWINGS

Figure 1:
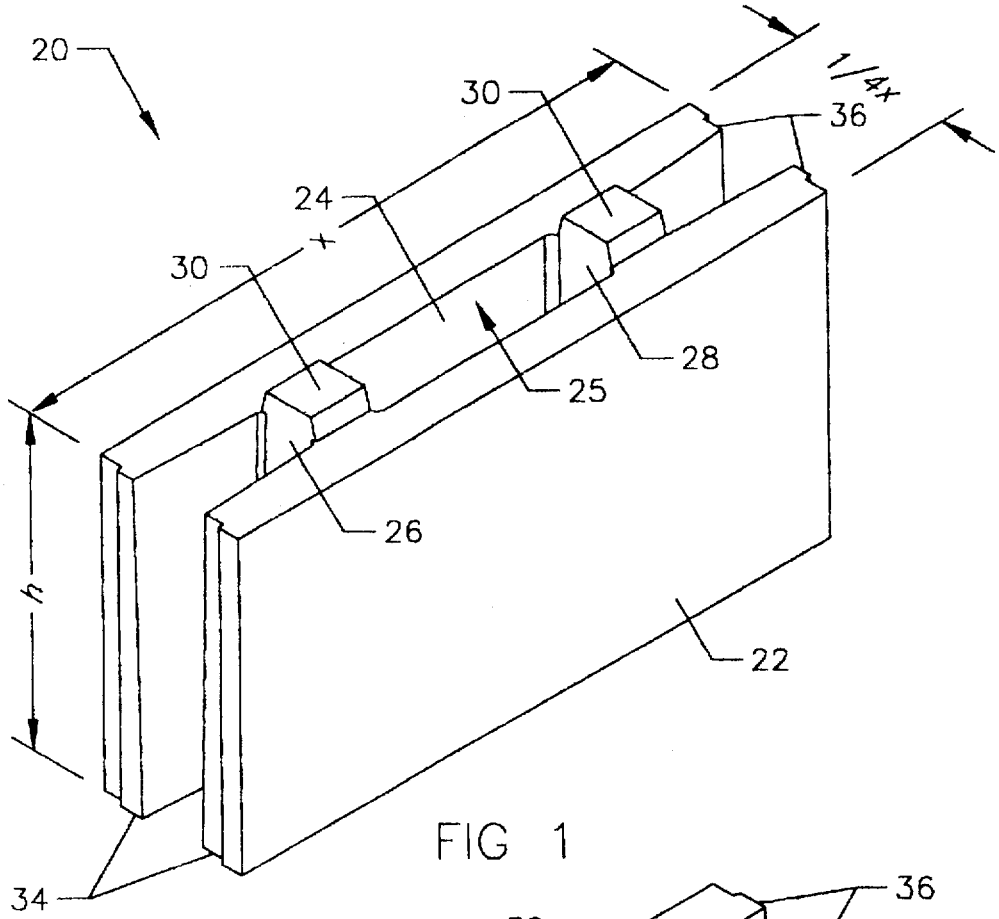
FIG. 1 is a perspective view from the top of a standard block having a nominal predetermined length x and a width ¼ x, in accordance with the invention.
Figure 2:
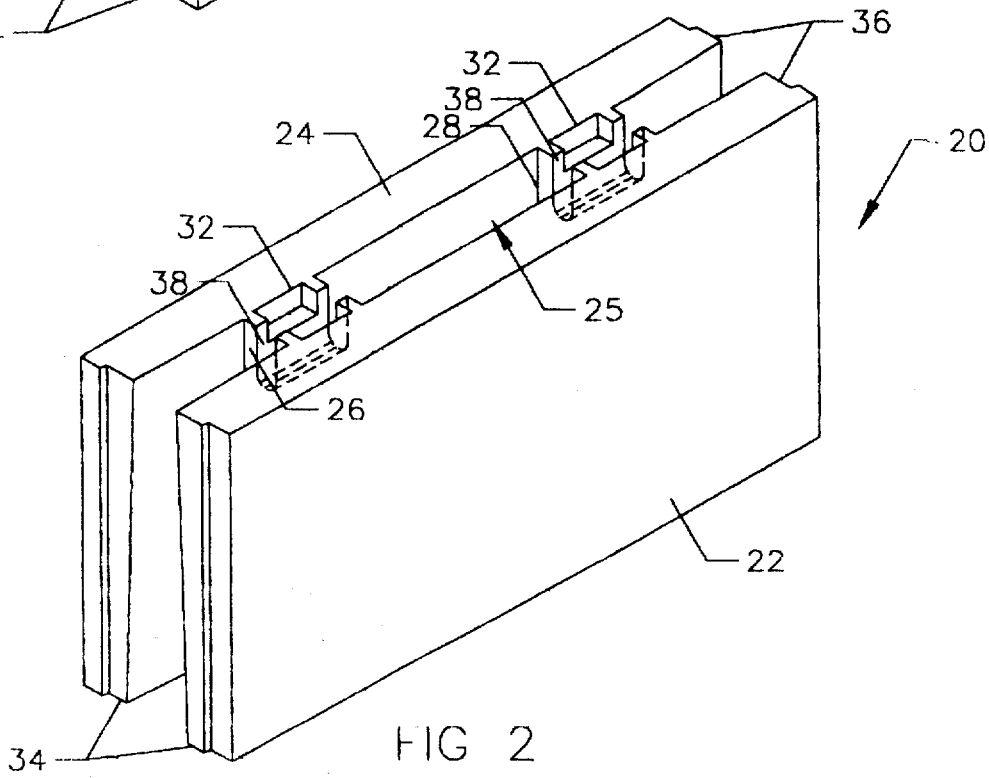
FIG. 2 is a perspective view from the bottom of the block of FIG. 1.
Figure 3:
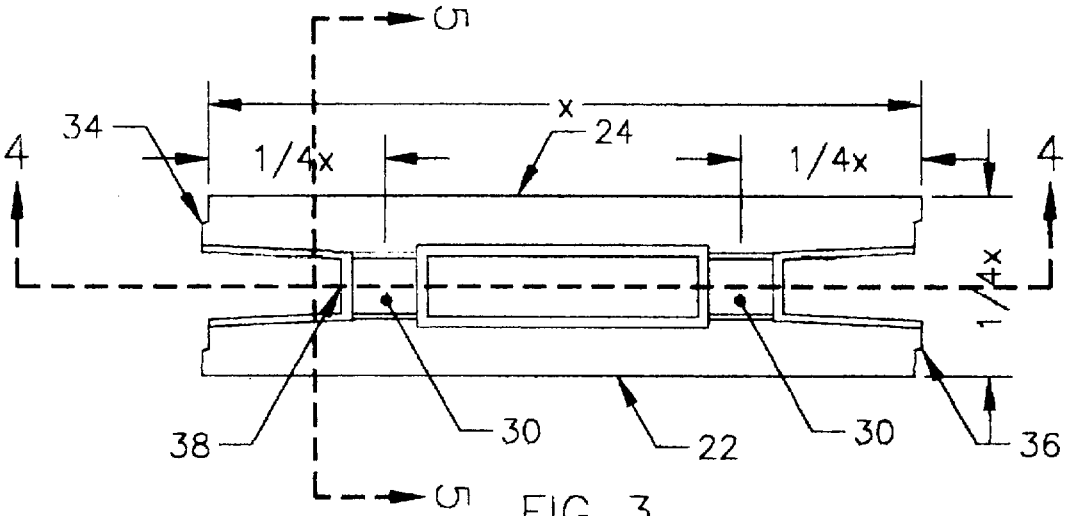
FIG. 3 is a top plan view of the block of FIG. 1 (drawn to a smaller scale)
Figure 4:
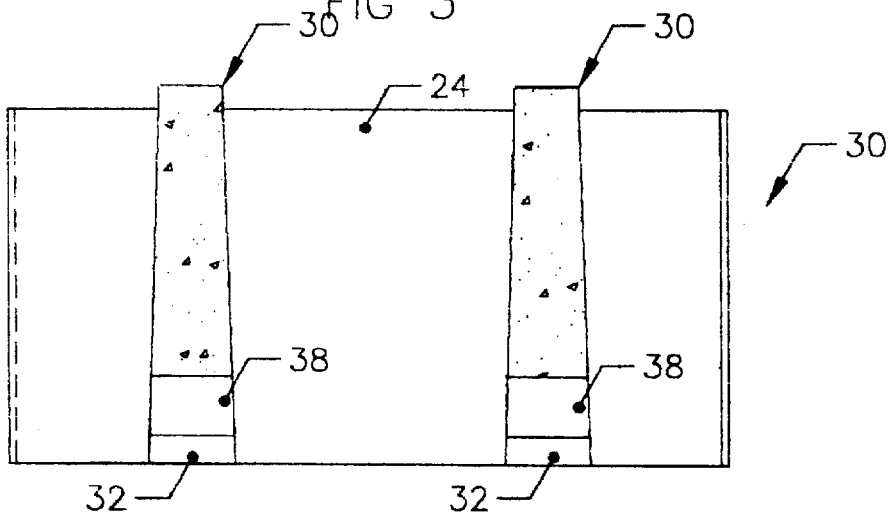
FIG. 4 is a cross-sectional view taken on line 4—4 of FIG. 3.
Figure 5:
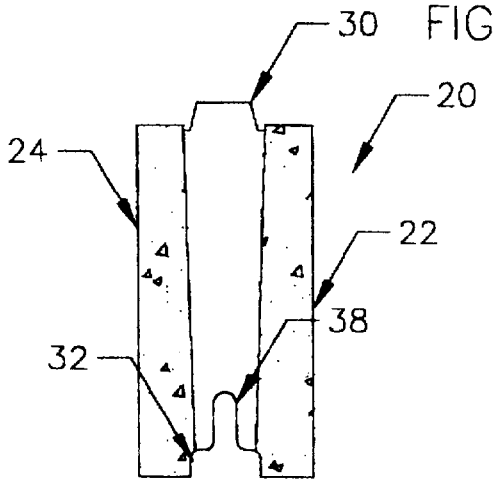
FIG. 5 is a cross-sectional view taken in line 5—5 of FIG. 3.
Figure 6:
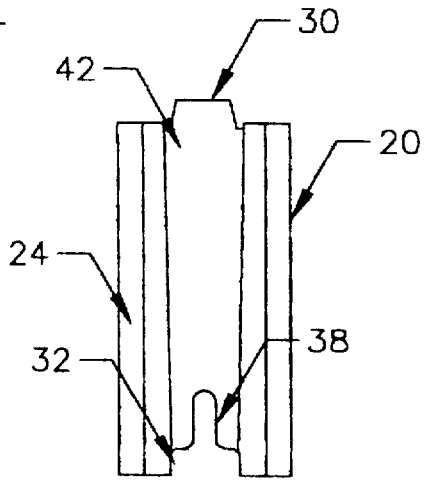
FIG. 6 is an end elevation of the block of FIG. 1 showing a reinforcement bar in association with the block.

A standard building block made in accordance with the invention is generally designated in FIGS. 1 to 6 by the reference numeral 20. The block 20 has an outer face shell 22 in spaced parallel relationship with an inner face shell 24. The face shells 22, 24 are substantially rectangular and have a nominal predetermined length x, typically 400 mm, between respective ends and a height h defining the length and height for the block respectively. A pair of transversely disposed bridge portions 26, 28 extend between the outer and inner face shells 22, 24 and are inwardly spaced from the ends of the face shells by a distance ¼ x. The separation between the exterior surfaces of the face shells is also ¼ x and defines the width of the block which, in this case, is 100 mm. A cavity generally indicated by numeral 25 is defined by the space formed between the face shells 22, 24 and the bridge portions 26, 28.

On the operatively upper surface of each bridge portion 26, 28, there is a projection 30 having a square profile which is centered between the face shells 22, 24. A corresponding recess 32 (FIG. 2) having a complementary square profile is formed on the operatively lower surface of each bridge portion 26, 28 and is similarly centered between the face shells 22, 24 to be adapted to receive a projection 30 of an underlying block. For ease of molding, the bridge portions 26, 28 are somewhat tapered so that they are narrower at their top surfaces where they carry the projections than at their bottom surfaces where the recesses are formed. The projection 30 is also dimensioned so that it will be accommodated in the cavity 25 of an overlying block as will be described further below with reference to FIGS. 12 and 13, the width of the projection corresponding to the separation between the inner surfaces of the face shells 22, 24 at the bottom of block 20 in the cavity 25 and also at the ends of the blocks.

The inner and outer face shells 22, 24 have profiled ends 34, 36 with an L-shaped cross-section. At a first end of the block 20, the ends 34 have a similar "left corner" orientation, whereas at the opposite end of the block, the ends 36 have a complementary "right corner" orientation, the ends of the block being adapted to cooperate with ends of adjacent blocks. It will be understood that a horizontally adjacent block will interlock at the ends whether it is disposed with the outer face shell on the outside of the wall or the inside of the wall. This greatly facilitates the mason's job as it is not required to orient the block before laying it down. Because there is an overlap between horizontally adjacent blocks, the profiled ends 34, 36 create a physical as well as a visual barrier which is aesthetically more pleasing and which increases the stability of the wall. The nominal length x between the ends of the face shells is defined by the apparent length of the blocks when laid end to end.

A groove 38 is formed in each of the bridge portions 26, 28, the groove extending upwardly through the operatively lower surface and the recess 32 of each bridge portion and traversing the length of each bridge portion so as to define a "rebar chase" for accommodating a reinforcement bar 40 of indefinite length traversing the length of the block. The reinforcement bar 40 (shown in FIG. 6) would be inserted in the grooves 38 and retained in position with tie wires 42 looped over the associated bridge portions 26, 28. It will be noted from FIGS. 5 and 6, that the operatively upper surface of the bridge portions 26, 28 is downwardly spaced from the operatively upper surface of the inner and outer face shells 22, 24 and thereby defines a pair of notches 43 on opposite sides of the projections 30 for locating the tie wires 42. Segments of such a reinforcement bar 40 would normally extend the length of the wall being constructed and would be disposed at about one-third to one-half the height of the wall, at the top course of blocks, and over any openings in a wall such as doors and windows, respectively, according to engineering requirements. Advantageously, the location of the reinforcement bar 40 at the bottom of a block places it adjacent to an opening where maximum reinforcement is desirable.

Figure 7:
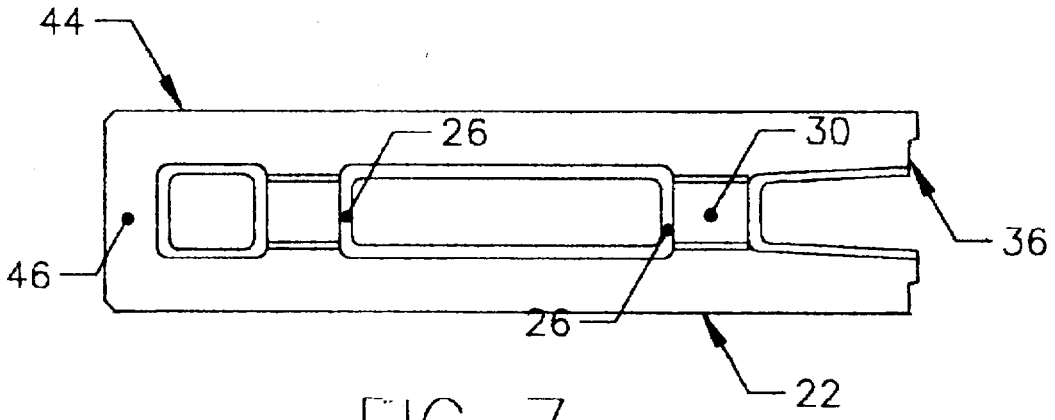
FIG. 7 is a top plan view showing a first variant of the block of FIG. 1 having one closed end.

A variant 44 of the block 20 is shown in FIG. 7 and is similar in all respects to the block 20 but additionally includes a transverse end portion 46, joining the ends 34 of the face shells at one end of the block and is intended to be used for finishing a wall end or wall opening.

Figure 8:
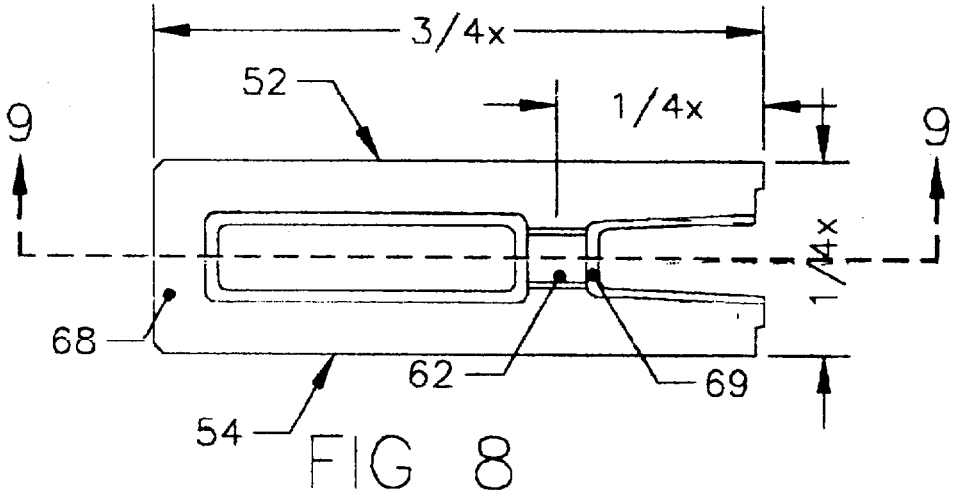
FIG. 8 is a top plan view showing a second variant of the block of FIG. 1 having a nominal predetermined length ¾ x.
Figure 9:
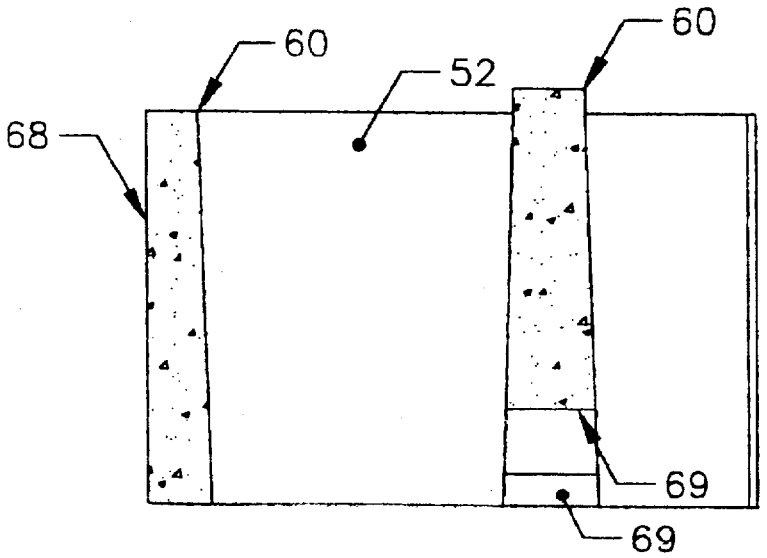
FIG. 9 is a cross-sectional view taken on line 9—9 of FIG. 8.
Figure 10:
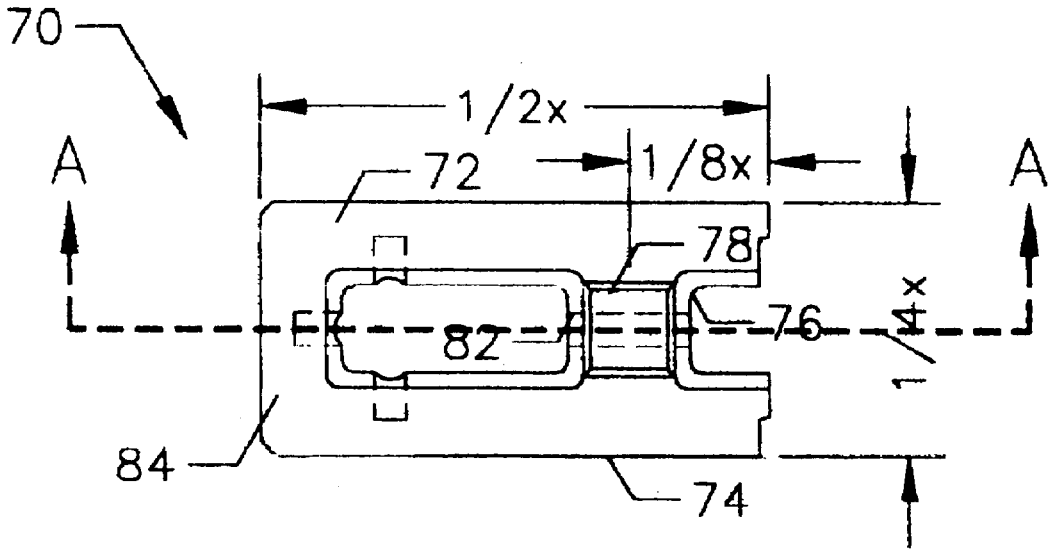
FIG. 10 is a top plan view showing a third variant of the block of FIG. 1 having a nominal predetermined length ½ x.
Figure 11:
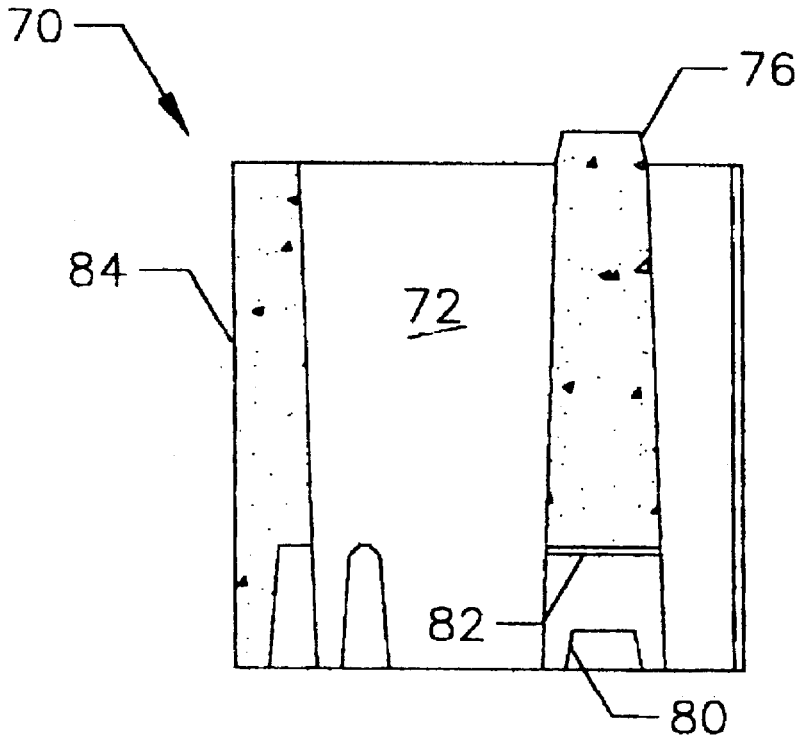
FIG. 11 is a cross-sectional view taken on line 11—11 of FIG. 10.

Another variant 50 of the block 20 drawn in FIGS. 8 and 9 has a nominal predetermined length for the face shells 52, 54 equal to ¾ x, and will be referred to as a "¾ block". The ¾ block is characterized by a pair of bridge portions 56, 58 each carrying a respective projection 60, 62 and having a corresponding recess 64, 66. A first bridge portion 58 is located so that the associated projection is spaced from the nearest ends of the face shells 52, 54 by a distance ¼ x whereas the second bridge portion 56 is located so that the associated projection is spaced from the nearest ends of the face shells 52, 54 by a distance ⅛ x. A transverse end portion 68 joins the ends of the face shells 52, 54 adjacent to the second bridge portion 56 and is intended to be used for finishing a wall end or wall opening in combination with a half-block 70 drawn in FIGS. 10 and 11. A rebar groove 69 extends from the transverse end portion 68 and through the first and second bridge portions 56, 58.

The half-block 70 has a nominal predetermined length for its face shells 72, 74 equal to ½ x and is characterized by a single bridge portion 76 carrying a projection 78 and a corresponding recess 80. A rebar-groove 82 is also provided through the bottom surface of the bridge portion 76. The ½ block is characterized by the bridge portion 76 being located so that the associated projection 78 is spaced from the nearest ends of the face shells 72, 74 by a distance ⅛ x. A transverse end portion 84 joins the ends of the face shells 72, 74 on the opposite side of the block.

Figure 12:
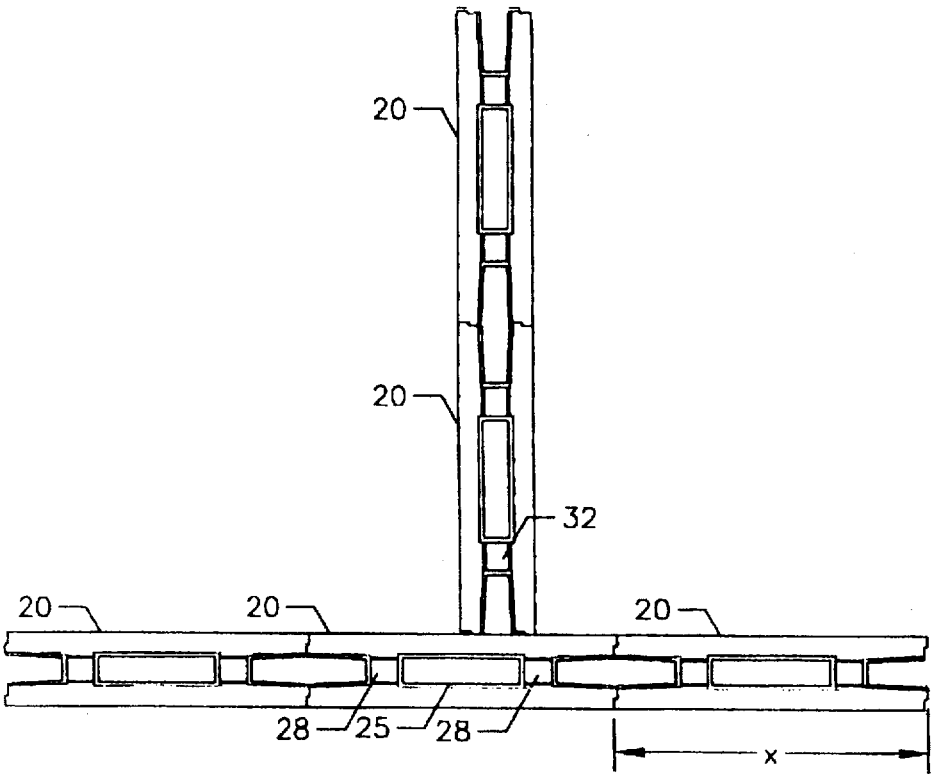
FIG. 12 is a schematic plan view from the top of a first course of blocks forming a T-wall.
Figure 13:
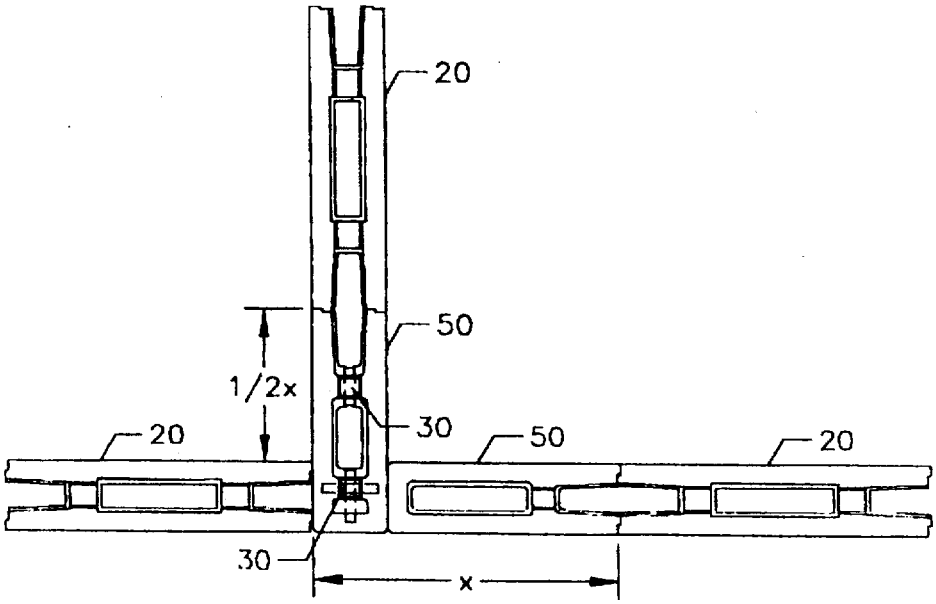
FIG. 13 is a schematic plan view from the top of a second course of blocks disposed over the blocks of FIG. 12.

A schematic plan view of a first course of blocks drawn in FIG. 12 shows a combination of full blocks 20 laid end to end to form a T-wall and in FIG. 13, a second course of blocks is shown, in which a pair of ¾ blocks 50 are disposed transversely to each other.

Since the width of the blocks is ¼ x, the combination of one ¾ block 50 at right angles to another ¾ block 50 completes a total modular length unit x, and the modular relationship with the underlying and overlying course of the blocks from left to right in FIG. 12 is maintained. For the blocks extending from top to bottom, it will be seen that the ¾ block 50 extends above the blocks extending from left to right by a distance ½ x so as to maintain the conventional stagger of one-half the length of the full blocks 20 used in the underlying and overlying course of blocks of FIG. 12. The projections 30 of the ¾ block 50 extending from top to bottom in FIG. 13 are positioned to fit in a recess 32 of an overlying standard full block 20 and in the cavity 25 formed between the bridge portions 26, 28 of a standard full block 20 extending from left to right (as drawn in FIG. 12).

Figure 14:
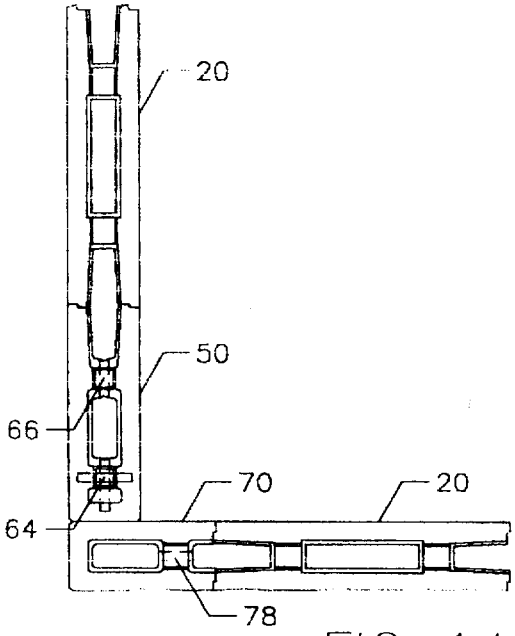
FIG. 14 is a schematic plan view from the top of a first course of blocks forming a corner.
Figure 15:
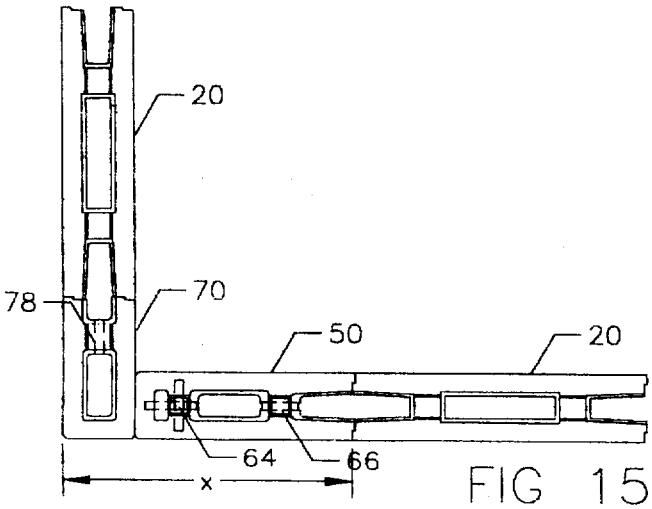
FIG. 15 is a schematic plan view from the top of a second course of blocks disposed over the blocks of FIGS. 14.

Alternate courses of blocks in a corner configuration are drawn in FIGS. 14 and 15 and include a ¾ block 50 disposed transversely to a ½ block 70. The combination preserves the modular length unit x and the single projection 78 of the ½ blocks 70 are located to be received in the corresponding recesses 64 of the ¾ blocks 50.

Figure 16:
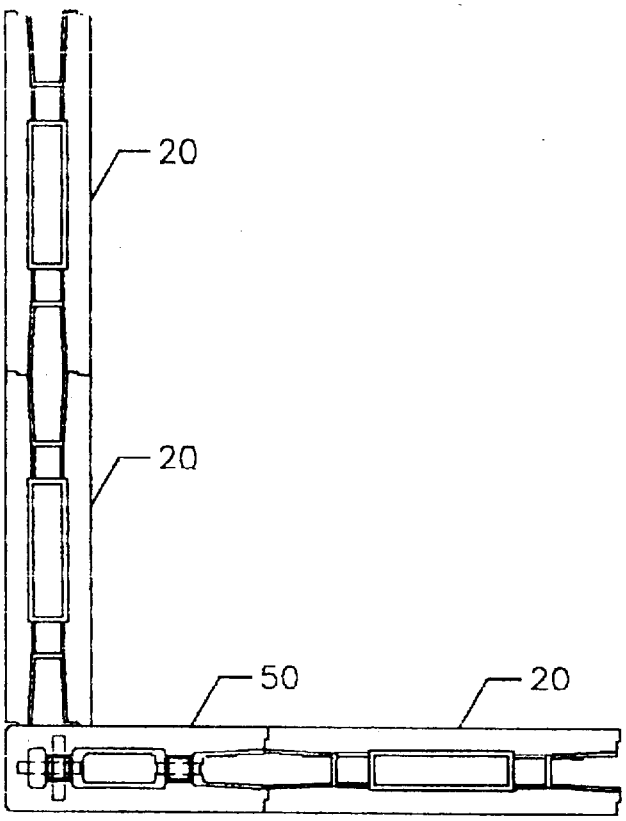
FIG. 16 is a schematic plan view from the top of a first course of blocks forming a corner.
Figure 17:
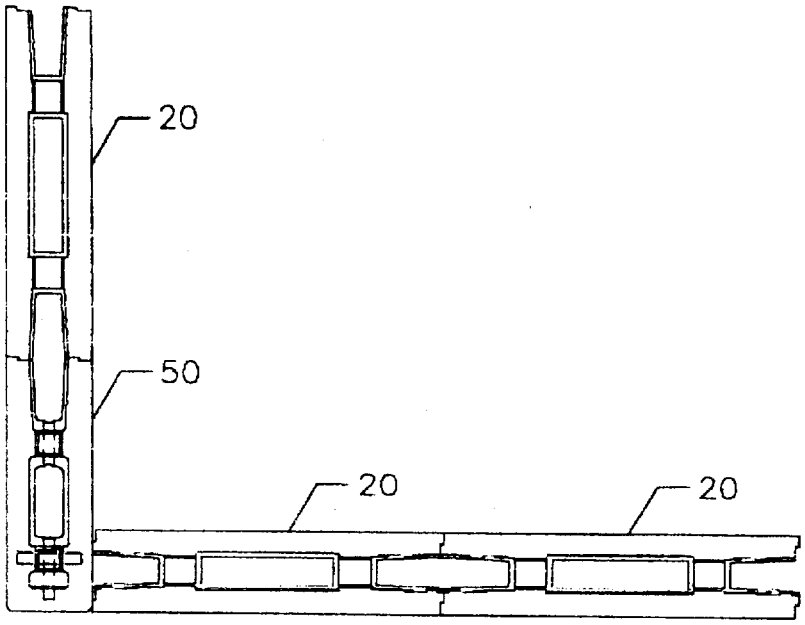
FIG. 17 is a schematic plan view from the top of a second course of blocks disposed over the blocks of FIG. 16.

Corners may alternatively be formed by combining a ¾ block 50 with a full block 20 as shown in FIGS. 16 and 17.

Figure 18:
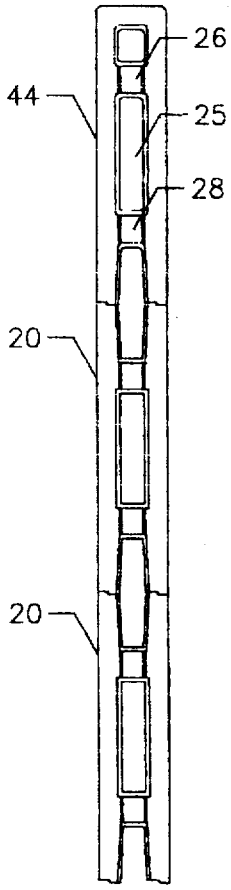
FIG. 18 (drawn adjacent FIGS. 14, 15) is a schematic plan view from the top of a first courses of blocks disposed end to end.
Figure 19:
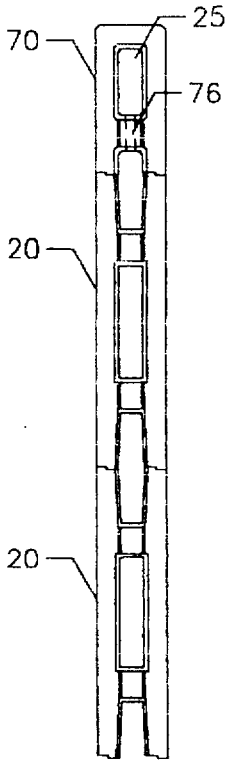
FIG. 19 (drawn adjacent FIG. 18) is a schematic plan view from the top of a second course of blocks disposed over the blocks of FIG. 18.

FIGS. 18 and 19 show standard full length blocks 20 disposed end to end to form a straight wall which is alternately finished by a full end block 44 and a half-block 70. The projection 76 of a half-block 70 is received in the cavity 25 of the full end block 44 and the projection 26 of a full-end block 44 is received into the cavity 25 of a half-block 70.

The four blocks described above with reference to FIGS. 1–11 all have a nominal width of ¼ x or 100 mm and together they may be combined to make complex architectural features, as shown in the schematic views of FIGS. 12–19 notwithstanding that the length to width ratio is 4:1 and that the projections and recesses of these interlocking blocks are in pre-defined locations.

Another set of blocks is required where the length to width ratio changes. The following blocks will again have a nominal modular length x but the width selected is ⅜ x or 150 mm for a length x equal to 400 mm.

Figure 20:
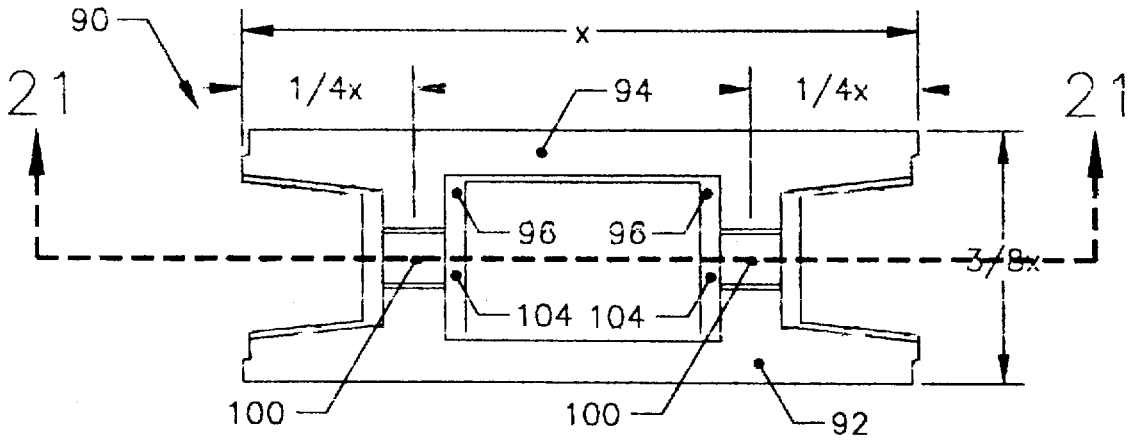
FIG. 20 is a top plan view of a block having a nominal predetermined length x and a width ⅜ x, in accordance with the invention.
Figure 21:
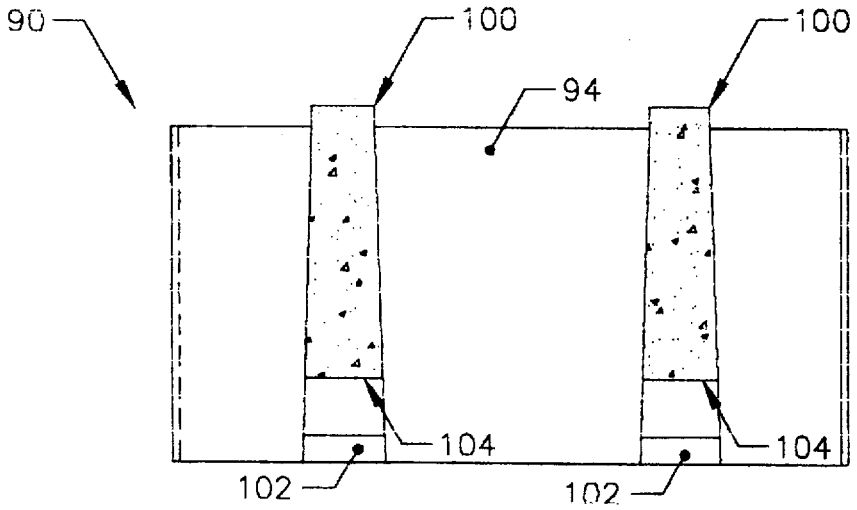
FIG. 21 is a cross-sectional view taken on line 20—20 of FIG. 20.

The full length standard block shown in FIG. 20 is generally indicated by reference numeral 90 and has an outer face shell 92 in spaced parallel relationship with an inner face shell 94. The face shells 92, 94 have a nominal predetermined length x between respective profiled ends and a pair of transversely disposed bridge portions 96, 98 extend between the outer and inner face shells 92, 94 and are inwardly spaced from the ends of the face shells. The separation between the exterior surfaces of the face shells is ⅜ x and defines the width of the block.

On the operatively upper surface of each bridge portion 96, 98, there is a projection 100 centered between the face shells 92, 94 and spaced from the ends of the face shells by a distance ¼ x. A corresponding recess 102 is formed on the operatively lower surface of each bridge portion 96, 98 and is similarly centered between the face shells 92, 94 to be adapted to receive a projection of an underlying block. A rebar groove 104 extends through the bottom surfaces of each bridge portion 96, 98.

Figure 22A:
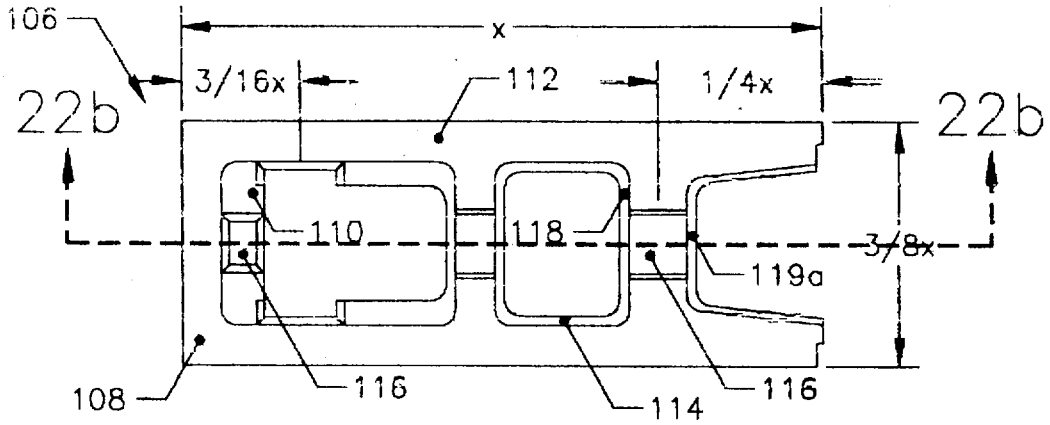
FIG. 22*a* is a top plan view showing a first variant of the block of FIG. 20 having one closed end.
Figure 22B:
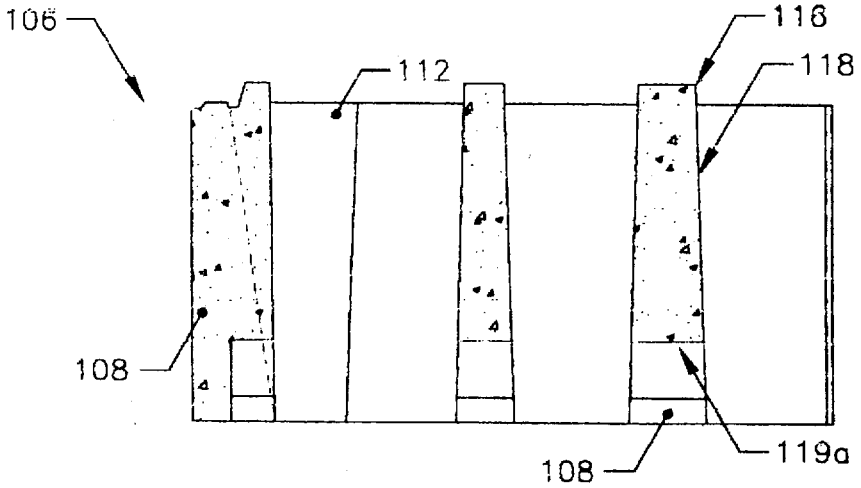
FIG. 22*b* is a cross-sectional view taken on 22*b*—22*b* of FIG. 22*a;*
Figure 22C:
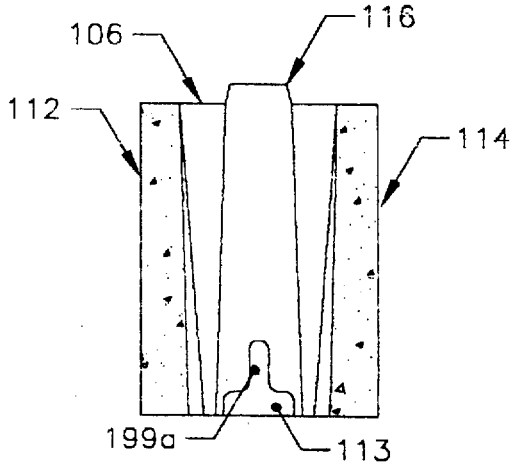
FIG. 22*c* is a cross-sectional view taken on 22*c*—22*c* of FIG. 22*b;*

A full end-block variant 106 of the block 90 drawn in FIGS. 22*a*, 22*b*, 22*c* is similar to the block 90 but additionally includes a transverse end portion 108 adjacent to a first bridge portion 110 extending between face shells 112, 114. The bridge portion 110 carries a projection 116 which is spaced from the end of the face shells, or end portion 108, by a distance 3/16 x while the other bridge portion 118 is located so that the associated projection 116 is spaced from the other end of the face shells by a distance ¼ x. Corresponding recesses 113, 115 are formed on the operatively lower surface of each bridge portion 110, 118 and are similarly centered between the face shells 112, 114 to be adapted to receive a projection of an underlying block. A longitudinally-extending rebar groove 119*a* extends through the bottom surfaces of each bridge portion 110, 118 and a transversely-extending rebar groove 119*b* is formed in the bottom surface of the first bridge portion 110 where it stops short of penetrating the face shells 112, 114 which are however weakened and may be easily pierced to accommodate a transversely-extending reinforcement bar, for example, at the corner of a wall structure.

In addition, the recess 113 formed on the bottom surface of the first bridge portion 110 opens into the cavity formed between the face shells 112, 114 thereby defining a wider opening which can accommodate projections 100 of underlying standard blocks 90 which are spaced from the end of the face shells by a distance of ¼ x.

Because the blocks 90, 106 are wider, there is enough space separating the inner and outer face shells to provide room for notches 117 (FIG. 22C) formed in the operatively upper surface of the bridge portion 110 on opposite sides of the projection 116 for locating a tie wire to support a reinforcement bar while forming the remainder of the bridge portion flush with the operatively upper surface of the inner and outer face shells 112, 114.

Figure 23A:
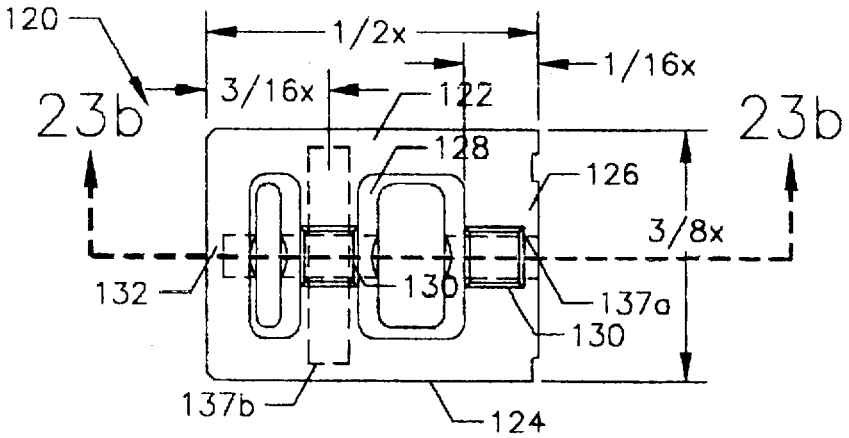
FIG. 23*a* is a top plan view showing a second variant of the block of FIG. 20 having a nominal predetermined length ½ x.
Figure 23B:
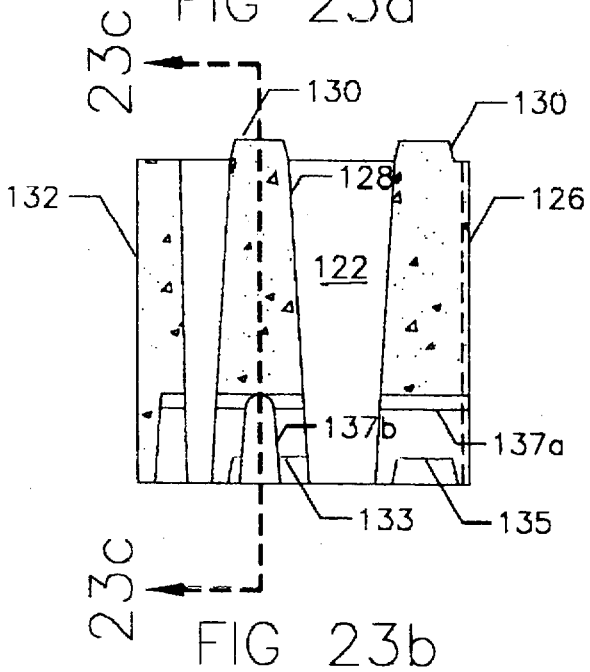
FIG. 23*b* is a cross-sectional view taken on 23*b*—23*b* of FIG. 23*a;*
Figure 23C:
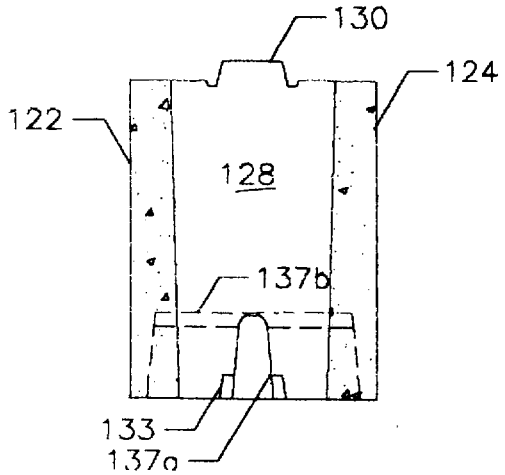
FIG. 23*c* is a cross-sectional view taken on 23*c*—23*c* of FIG. 23*b;*

The half-block 120 drawn in FIGS. 23*a*, 23*b*, 23*c* has a nominal predetermined length between the ends of its face shells 122, 124 equal to ½ x and has a pair of bridge portions 126, 128 extending therebetween, the first bridge portion 126 being located so that the associated projection 130 is spaced from one said end by a distance 1/16 x while the other projection 130 is spaced from a transverse end portion 132 of the block by a distance 3/16 x. Corresponding recesses 133, 135 are formed on the operatively lower surface of each bridge portion 126, 128 and are similarly centered between the face shells 122, 124 to be adapted to receive a projection of an underlying block. A longitudinally-extending rebar groove 137*a* extends through the bottom surfaces of each bridge portion 126, 128 and a transversely-extending rebar groove 137*b* is formed in the bottom surface of the first bridge portion 128 where it stops short of penetrating the face shells 122, 124 which are however weakened and may be easily pierced to accommodate a transversely-extending reinforcement bar, for example, at the corner of a wall structure.

In addition, the recess 133 formed on the bottom surface of the first bridge portion 128 opens into the cavity formed between the face shells 122, 124 thereby defining a wider opening which can accommodate projections 100 of underlying standard blocks 100 which are spaced from the end of the face shells by a distance of ¼ x.

As in the block 106, FIG. 23C shows a pair of notches 131 formed in the operatively upper surface of the bridge portion 128 on opposite sides of the projection 130 for locating a tie wire to support a reinforcement bar.

Figure 24A:
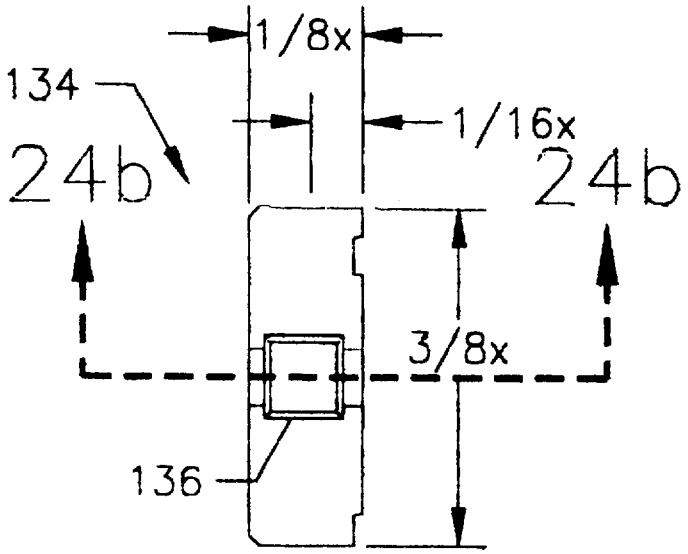
FIG. 24*a* is a filler block having a nominal predetermined length of ⅛ x.
Figure 24B:
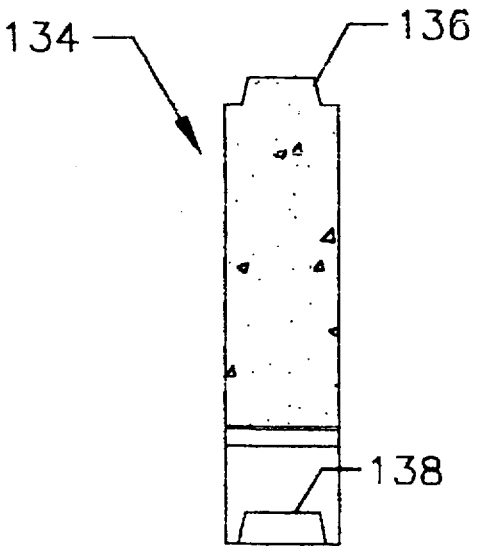
FIG. 24*b* is a cross-sectional view of the block taken on 24*b*—24*b* of FIG. 24*a;*

A filler block 134 shown in FIGS. 24*a* and 24*b* having a length of ⅛ x complements the set and has a height commensurate with the aforementioned blocks, and a width of ⅜ x. A centrally disposed projection 136 is disposed on the upper surface of the block 134 and a complementary recess 138 is formed in the lower surface of the block.

Figure 25A:
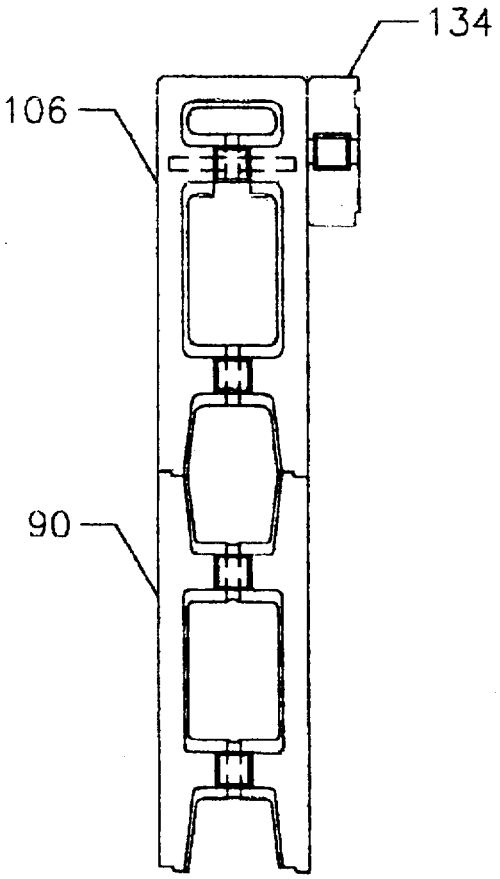
FIG. 25*a* is a schematic plan view from the top of a first course of blocks forming an L-corner.
Figure 25B:
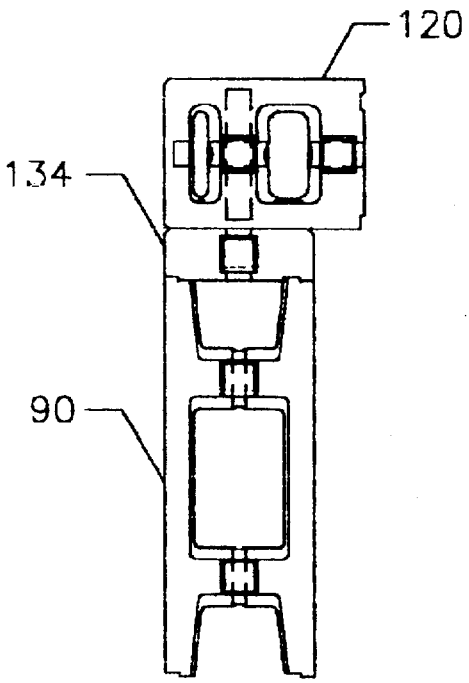
FIG. 25*b* is a schematic plan view from the top of a second course of blocks disposed over the blocks of FIG. 25*a*.

A schematic plan view of a first and second course of blocks drawn in FIGS. 25*a* and 25*b* show a combination of a full end block 106, a filler block 134, and a half-block 120 associated with a standard full block 90. The half-block 120 forms an interlock with the filler block 134 disposed below.

Figure 26:
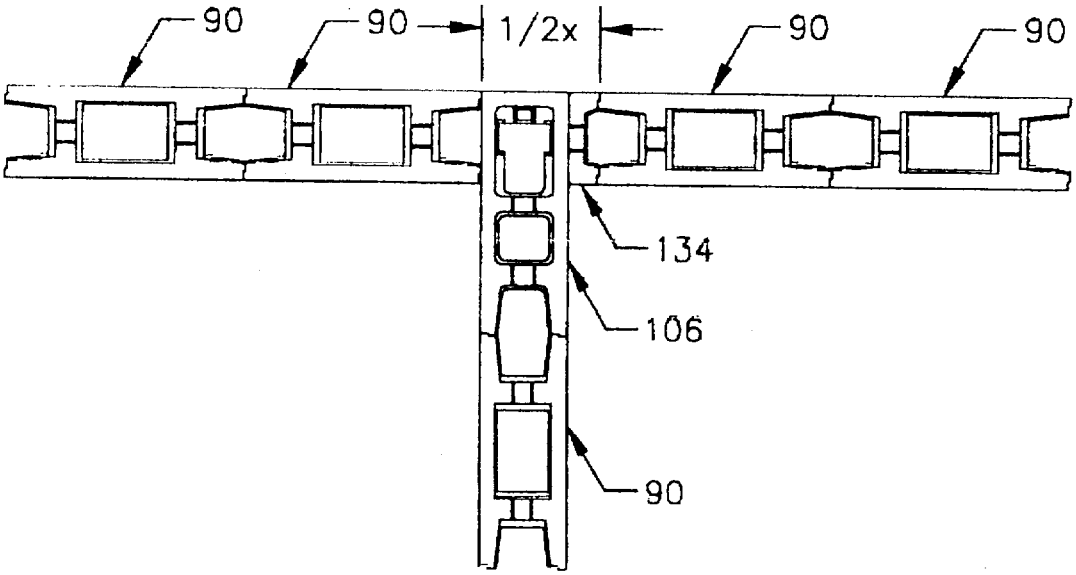
FIG. 26 is a schematic plan view from the top of a first course of blocks forming a T-wall.
Figure 27:
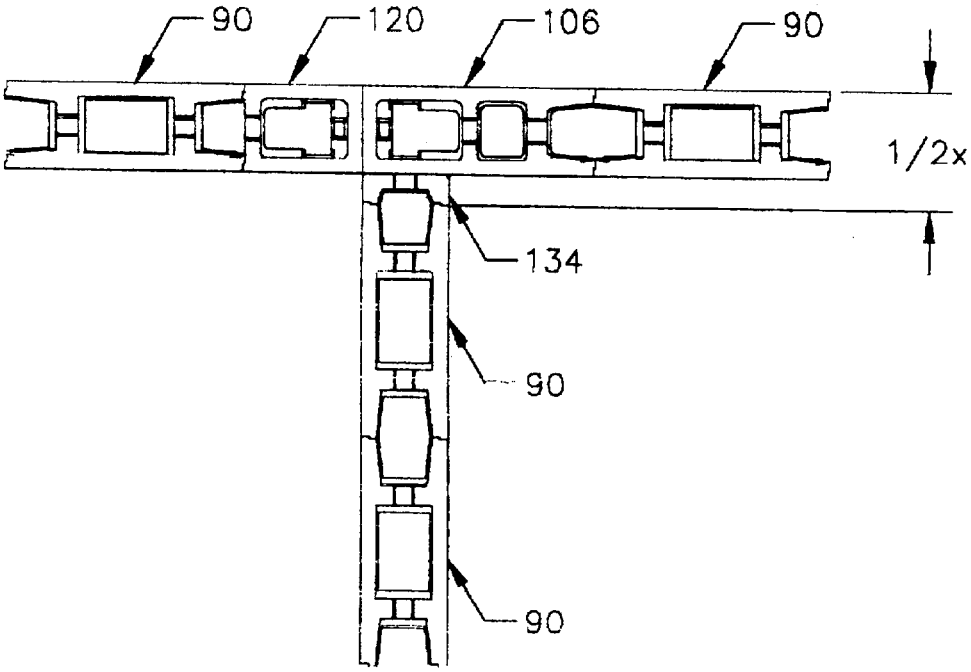
FIG. 27 is a schematic plan view from the top of a second course of blocks disposed over the blocks of FIG. 26.

A schematic plan view of a first course of blocks drawn in FIG. 26 shows a combination of the full block 90, full end-block 106, and the filler block 134 to form a T-wall and the alternating course of blocks drawn in FIG. 27 additionally includes the half-block 120. It will be seen in FIG. 26 that the filler block 134 disposed adjacent to a transverse full end-block 106 completes a half modular length unit x so that the conventional stagger of one-half the length of a full block can be maintained between the full blocks 90. Similarly, in FIG. 27, the filler block 134 is disposed between the full blocks 90 laid end to end from the top to the bottom, as drawn, and the blocks laid end to end between the left and right, as drawn, so that the combined width occupies a half modular length x and the conventional stagger of one-half the length of a full block can be maintained.

Figure 28:
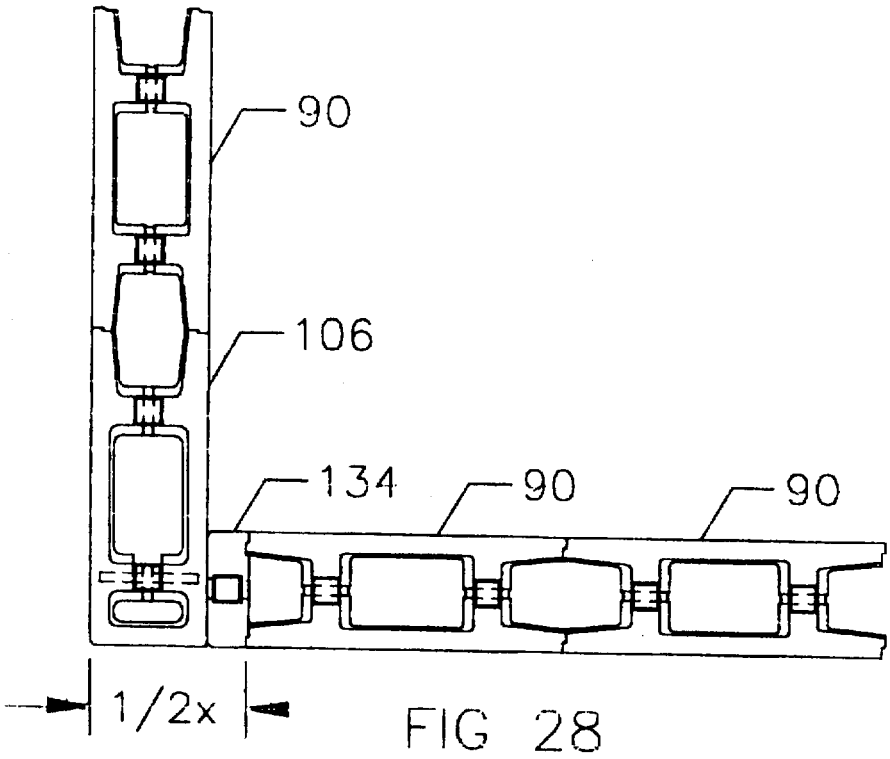
FIG. 28 is a schematic plan view from the top of a first course of blocks forming a corner.
Figure 29:
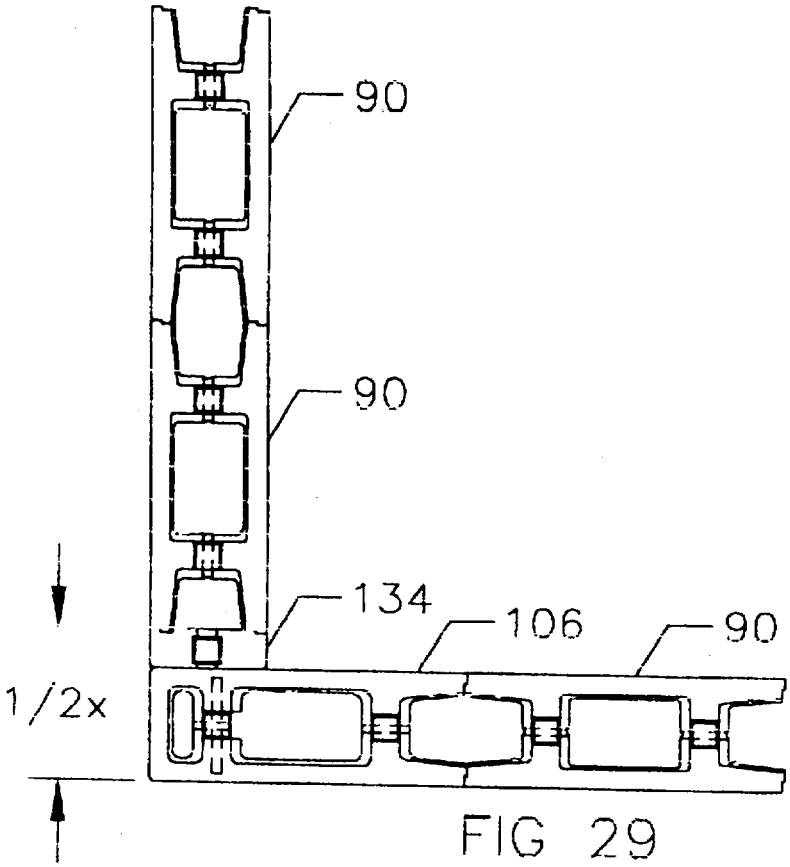
FIG. 29 is a schematic plan view from the top of a second course of blocks disposed over the blocks of FIG. 28.

The filler block 134 is again used between transverse courses of blocks in a corner application of which the first course is shown in FIG. 28 and the second course is shown in FIG. 29, the filler block 134 being disposed adjacent a full-end-block 106 to occupy a combined width of ½ x.

Figure 30A:
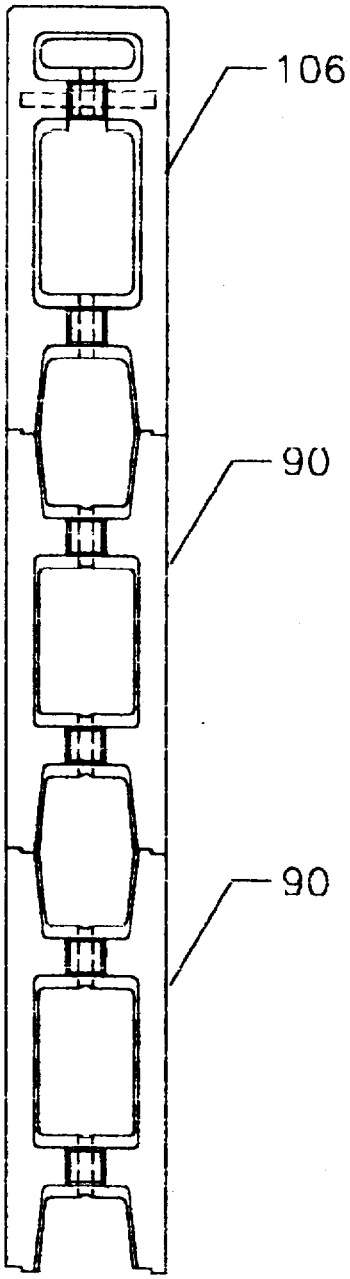
FIG. 30*a* is a schematic plan view from the top of a first course of blocks disposed end to end.
Figure 31A:
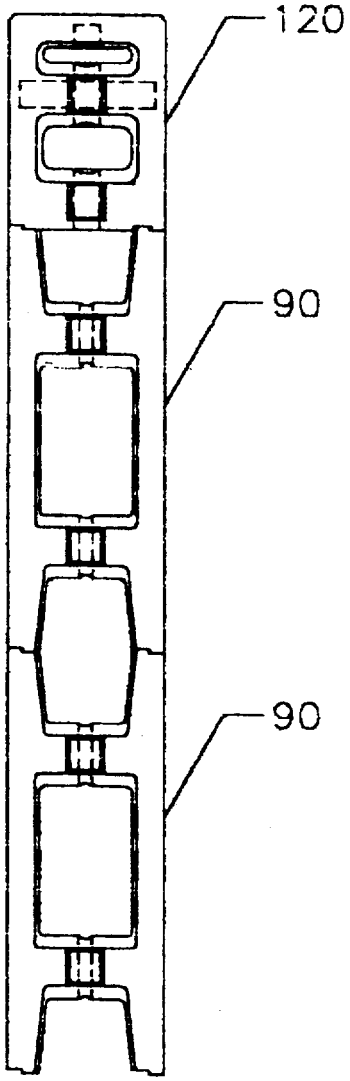
FIG. 31*a* (drawn adjacent FIG. 30*a*) is a schematic plan view from the top of a second course of blocks disposed over the blocks of FIG. 30.
Figure 30B:
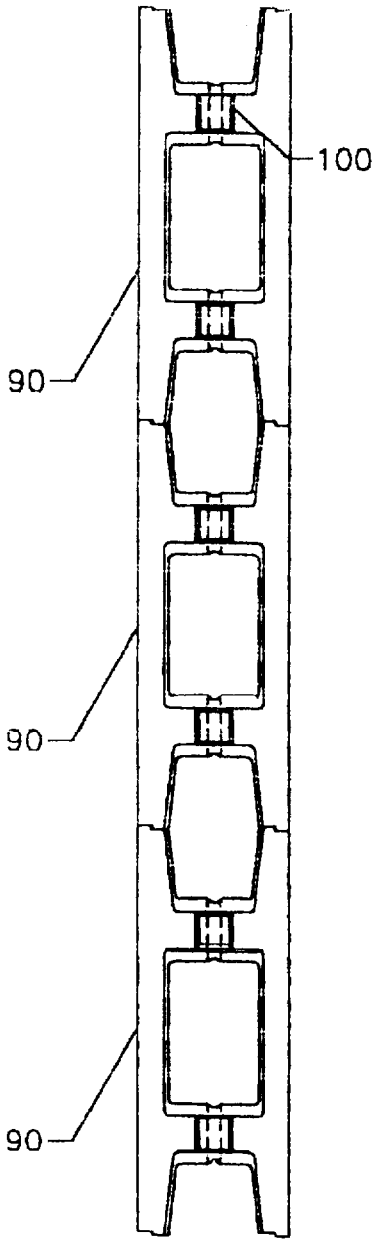
FIG. 30*b* is a schematic plan view from the top of a first course of blocks disposed end to end.
Figure 31B:
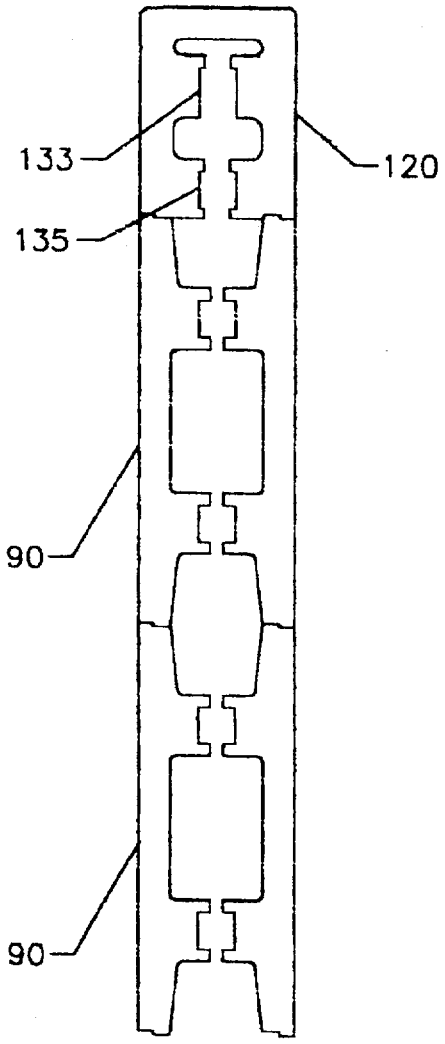
FIG. 31*b* (drawn adjacent FIG. 30*b*) is a schematic plan view from the bottom of a second course of blocks disposed over the blocks of FIG. 30*b;*
Figure 31C:
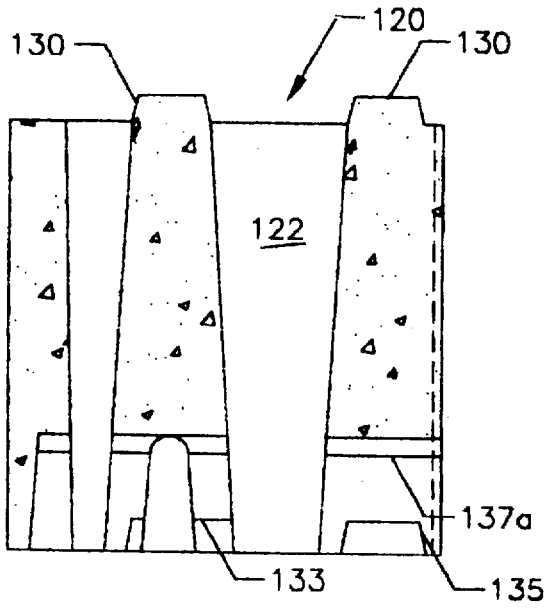
FIG. 31*c* is an exploded cross-sectional view showing the block of FIG. 23 associated with the block of FIG. 20.
Figure 31C:
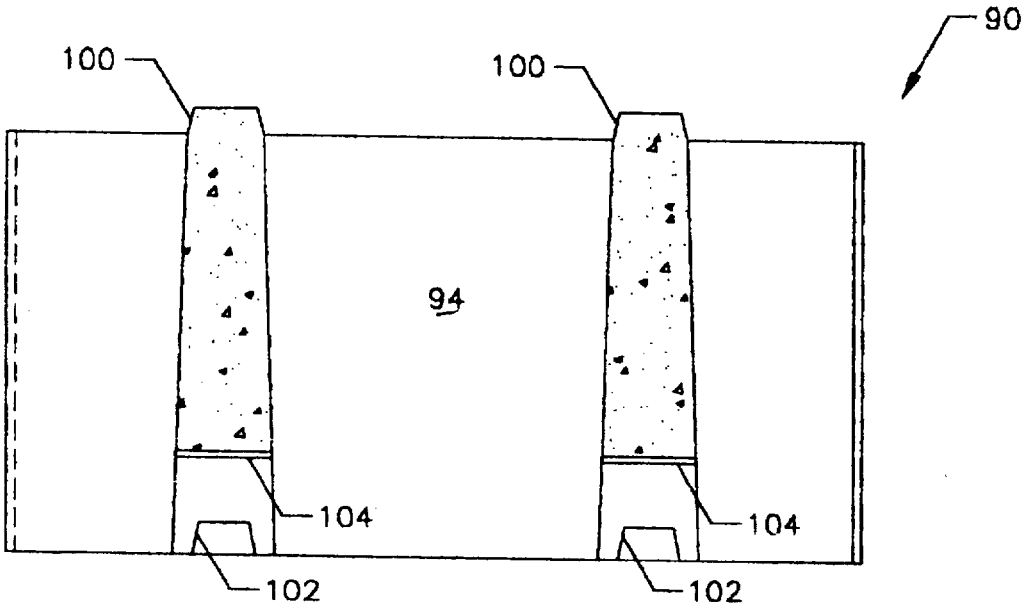

FIGS. 30*a* and 31*a* show the blocks disposed end to end to form a straight wall which is alternately finished by a full end-block 106 and a half-block 120, while in FIGS. 30*b*, 31*b*, the wall is finished by a standard block 90 and a half-block 120, respectively, the half-block 120 being drawn from the bottom to show that the projection 100 of the underlying standard block will be accommodated in the wider recess 133. For better understanding, a sectional view showing the association between a standard block 90 and a half-block 120 is drawn in FIG. 31*c*. It will be appreciated that the projection 100 is spaced from a respective end of the associated face shells by a distance ¼ x while the recess is correspondingly spaced by only 3/16 x. By opening into the cavity formed between the face shells 122, 124, the recess 133 is wide enough to receive the projection 100.

It will be appreciated that the configuration of the building block made in accordance with the invention may be embodied in a block having the conventional length-to-width ratio of 2:1. For completeness, a set of such blocks is described below with reference to FIGS. 32 to 34 and comprises a full-length standard block, a full-end block, and a half-block. Only three variations of blocks are required in this set because the length-to-width ratio of 2:1 readily allows the blocks to be combined to provide vertically adjacent rows staggered by one-half the length of a block.

Figure 32:
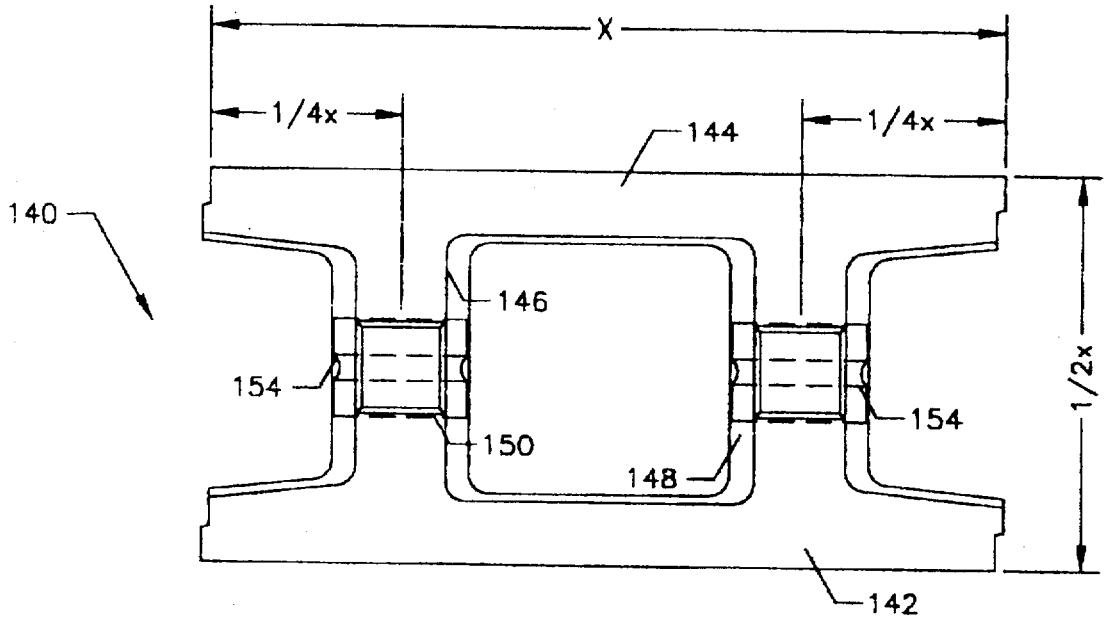
FIG. 32 is a top plan view of a block having a nominal predetermined length x and a width ½ x, in accordance with the invention.

The full-length standard block shown in FIG. 32 is generally indicated by reference numeral 140 and has an outer face shell 142 in spaced parallel relationship with an inner face shell 144. The face shells 142, 144 have a nominal predetermined length x between respective profiled ends and a pair of transversely disposed bridge portions 146, 148 extend between the outer and inner face shells 142, 144 and are inwardly spaced from the ends of the face shells. The separation between the exterior surfaces of the face shells is ½ x and defines the width of the block which, in this case, is 200 mm.

On the operatively upper surface of each bridge portion 146, 148, there is a projection 150 centered between the face shells 142, 144 and spaced from the ends of the face shells by a distance ¼ x. A corresponding recess (not shown) is formed on the operatively lower surface of each bridge portion 146, 148 and is similarly centered between the face shells 142, 144 to be adapted to receive a projection of an underlying block. A rebar groove 154 extends through the bottom surfaces of each bridge portion 146, 148.

Figure 33:
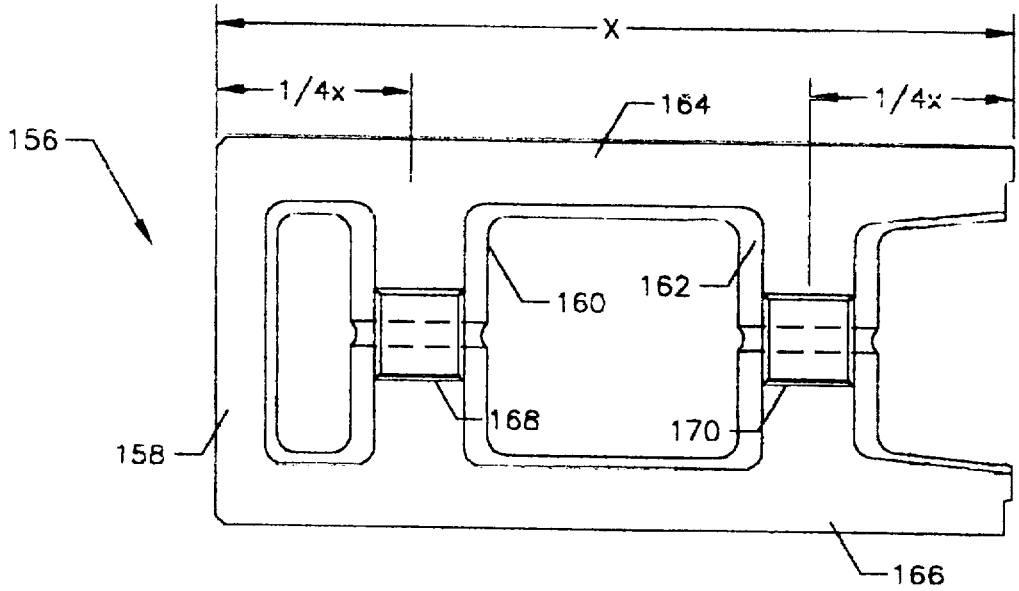
FIG. 33 is a top plan view showing a first variant of the block of FIG. 32 having one closed end.
Figure 34:
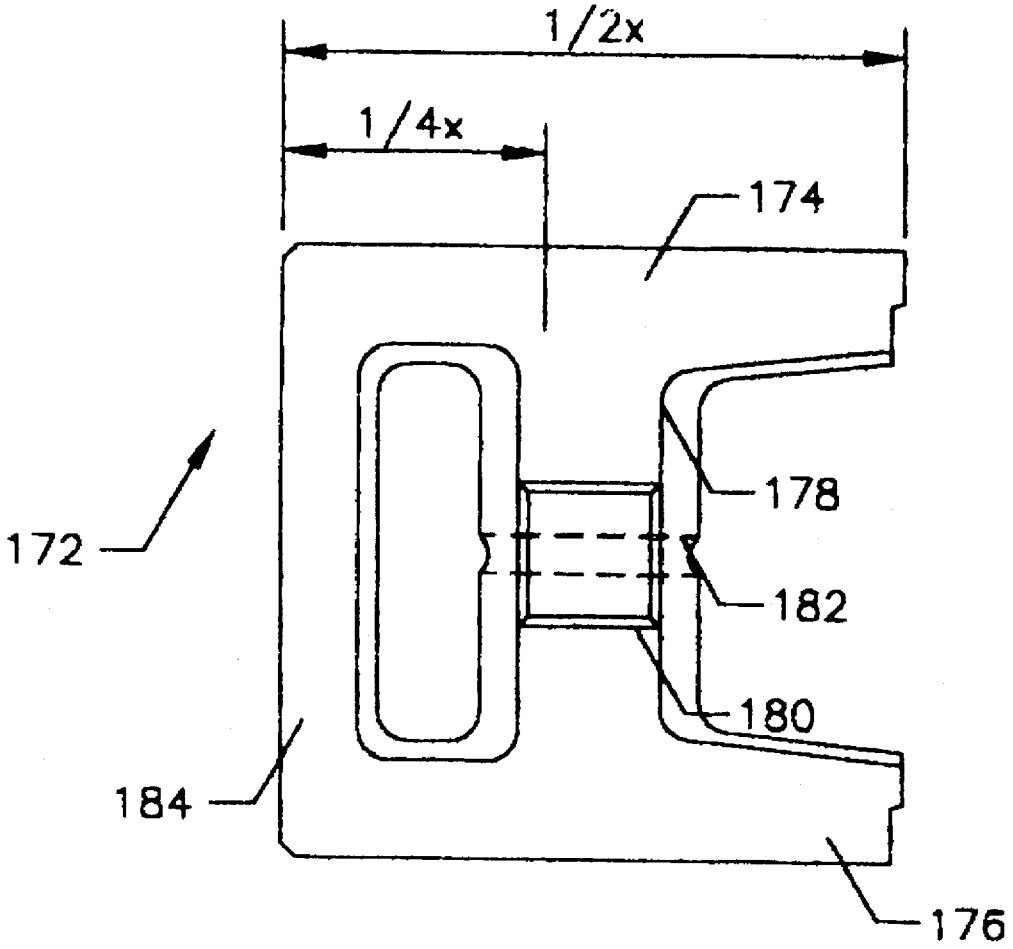
FIG. 34 is a top plan view showing a second variant of the block of FIG. 32 having a nominal predetermined length ½ x.

A full end-block variant 156 of the block 140 is drawn in FIG. 33 and is similar to the block 140 but additionally includes a transverse end portion 158 at one end of the block 140. A pair of transversely disposed bridge portions 160, 162 extend between outer and inner face shells 164, 166 and are inwardly spaced from the ends of the face shells so that the associated projections 168, 170 are spaced from a respective end of the face shells by a distance ¼ x or 100 mm.

The half-block 172 (FIG. 34) has a nominal predetermined length for its face shells 174, 176 equal to ½ x or 200 mm and is characterized by a single bridge portion 178 carrying a projection 180 and a corresponding recess (not shown). A rebar-groove 182 is also provided through the bottom surface of the bridge portion 178. The bridge portion 178 is located so that the association projection 180 is midway between the ends of the face shells 174, 176 at a distance ¼ x. A transverse end portion 184 joins the ends of the face shells 174, 176 on one side of the block.

Figure 35:
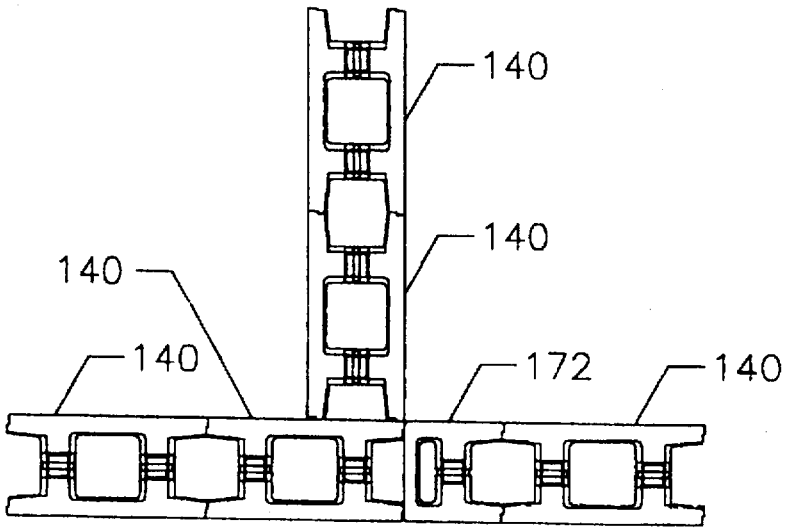
FIGS. 35–37 are schematic plan views from the top of a three course repeat forming a T-wall.
Figure 36:
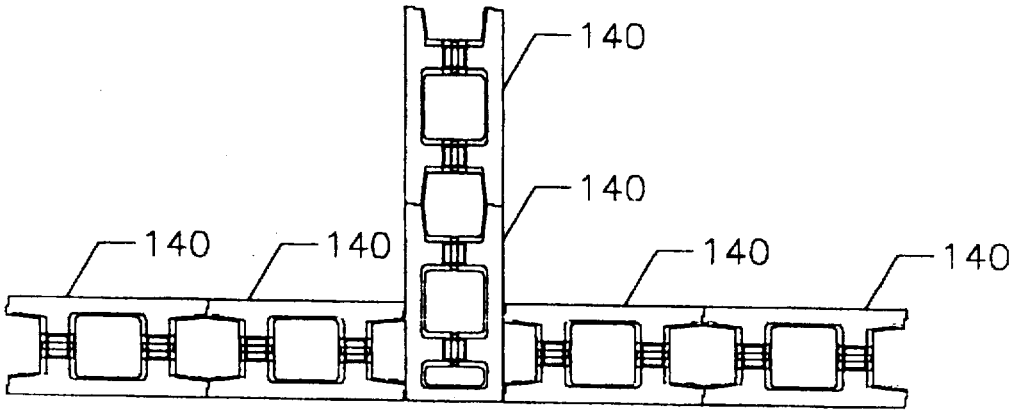
Figure 37:
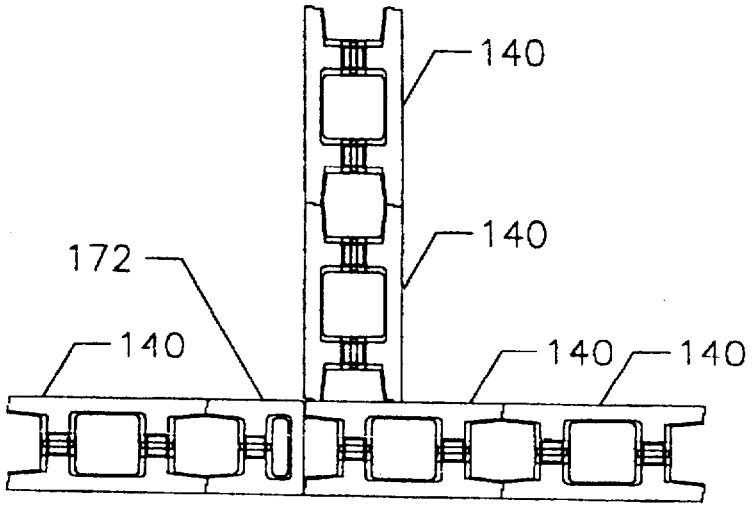

A three-course repeat drawn in FIGS. 35–37 shows a combination of full blocks 140 and half-blocks 172 laid end to end to form a T-wall. As will be appreciated by those skilled in the art, the blocks can readily be combined to form corners and straight walls (not shown).

Where the length-to-width ratio of a block is less than 2:1. for example, where the width is ¾ x for a nominal modular length unit x, the block is sufficiently wide to accommodate a pair of grooves or rebar-chases.

Figure 38:
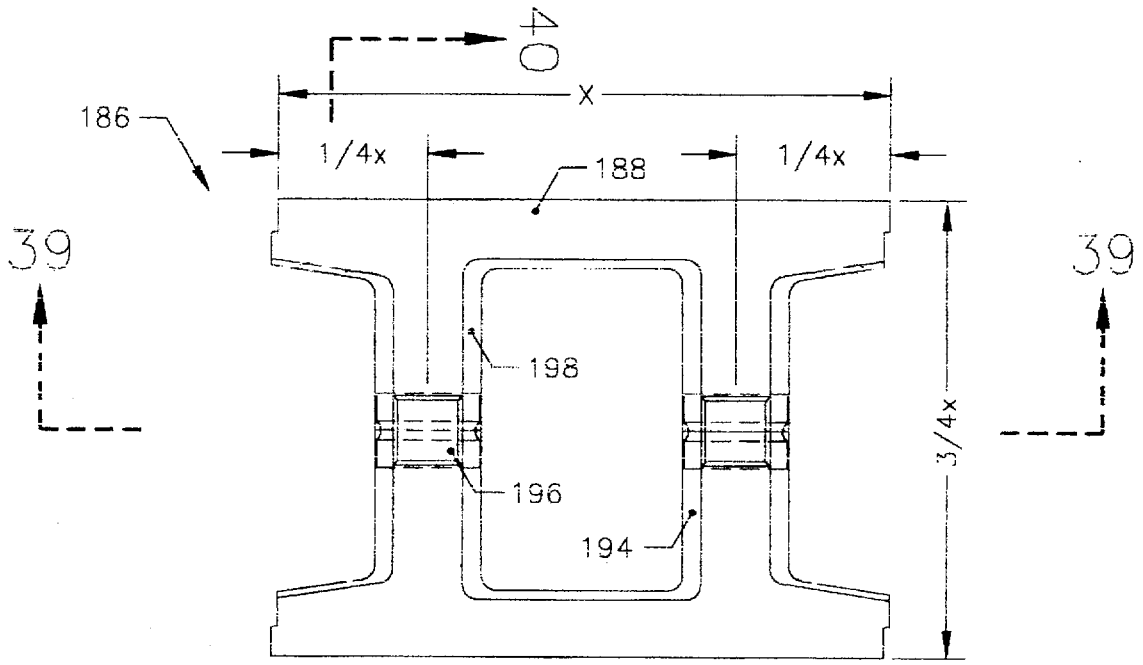
FIG. 38 is a top plan view showing a block having a nominal predetermined length x and a width ¾ x, in accordance with the invention.
Figure 39:
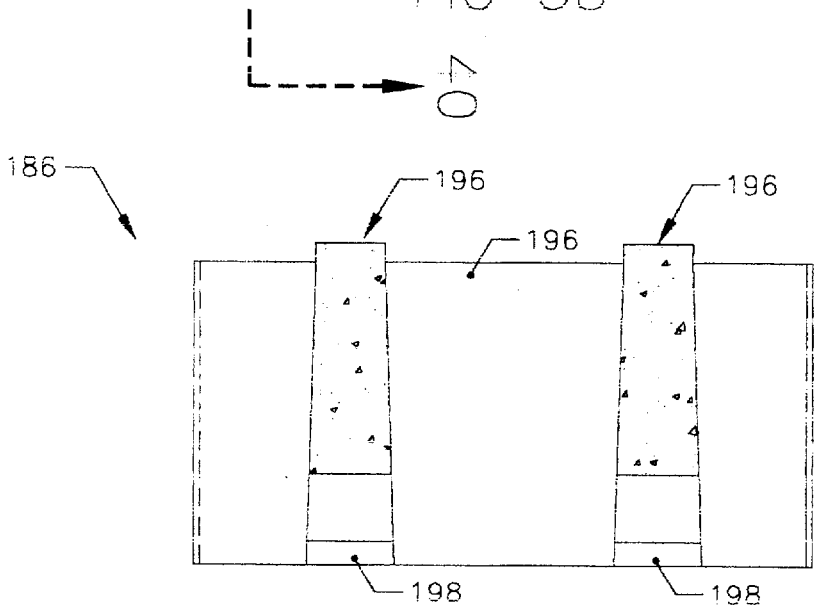
FIG. 39 is a cross-sectional view taken on line 39—39 of FIG. 38.
Figure 40:
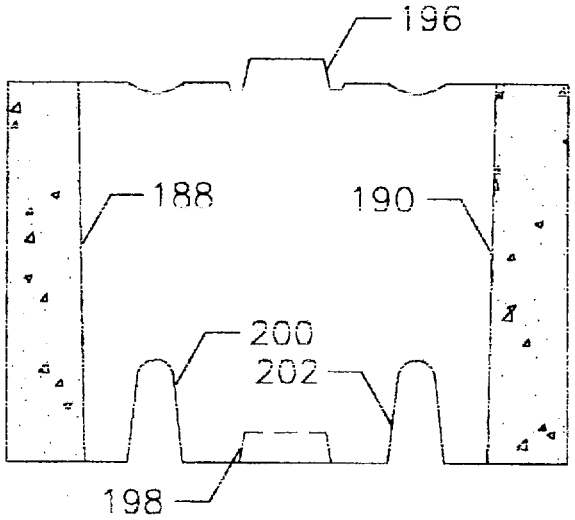
FIG. 40 is a cross-sectional view taken on line 40—40 of FIG. 38.

Such a block having a nominal length x equal to 400 mm and a width ¾ x equal to 300 mm is indicted by numeral 186 in FIGS. 38–40. A pair of spaced parallel face shells 188, 190 are connected by a pair of spaced parallel bridge portions 192, 194 inwardly spaced from the ends of the face shells and each carrying a protrusion 196 and a corresponding recess 198 centrally disposed from the ends of the face shells by a distance ¼ x or 100 mm.

A pair of spaced parallel grooves 200, 202 extend upwardly through the operatively lower surface of each bridge portion 192, 194, traversing the length of each bridge portion, and are disposed on opposite sides of the recess 198. Corresponding notches 197 formed in the operatively upper surface of the bridge portion 192 drawn in FIG. 40 are disposed on opposite sides of the projection 196 and are adapted to receive and locate loops of a respective tie wire for supporting a reinforcement bar. Paired with each notch 197 is a hollow groove 199 formed in the operatively upper surface of the bridge portion 192 between a respective one of each notch 197 and a face shell 188, 190 and provided to locate another loop of the associated tie wire.

Figure 41:
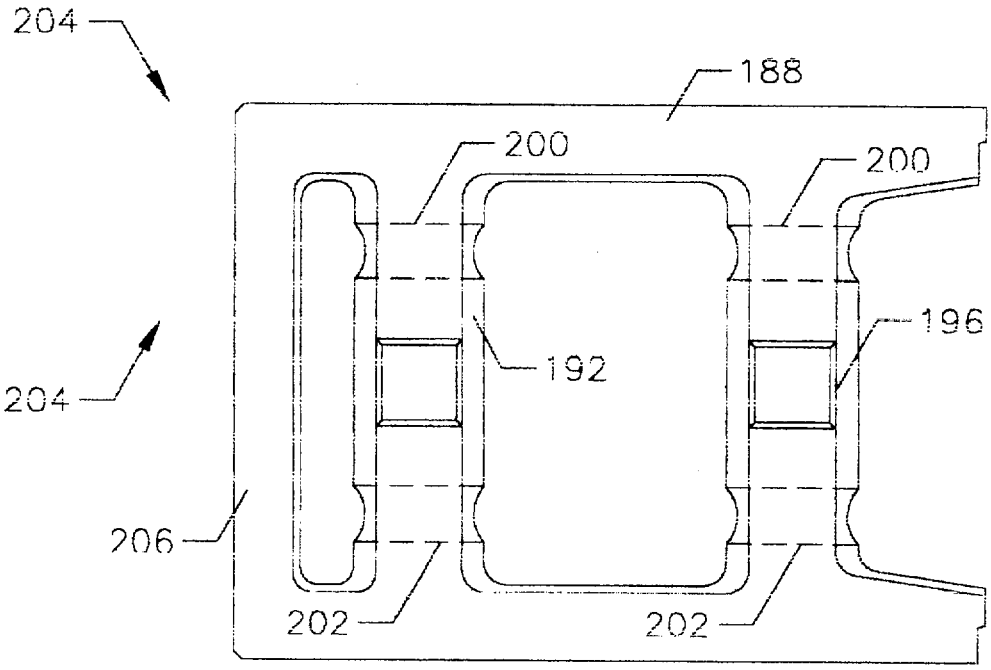
FIG. 41 is a top plan view showing a first variant of the block of FIG. 38 having one closed end.

A full end-block 204 is drawn in FIG. 41 and is similar in all respects to the block 186 with the exception that a transverse end portion 206 joins the ends of the face shells at one end of the block, so that it may be used to finish a wall end or wall opening. In FIG. 41, like numerals to FIG. 38 are used to identify like parts.

Figure 42:
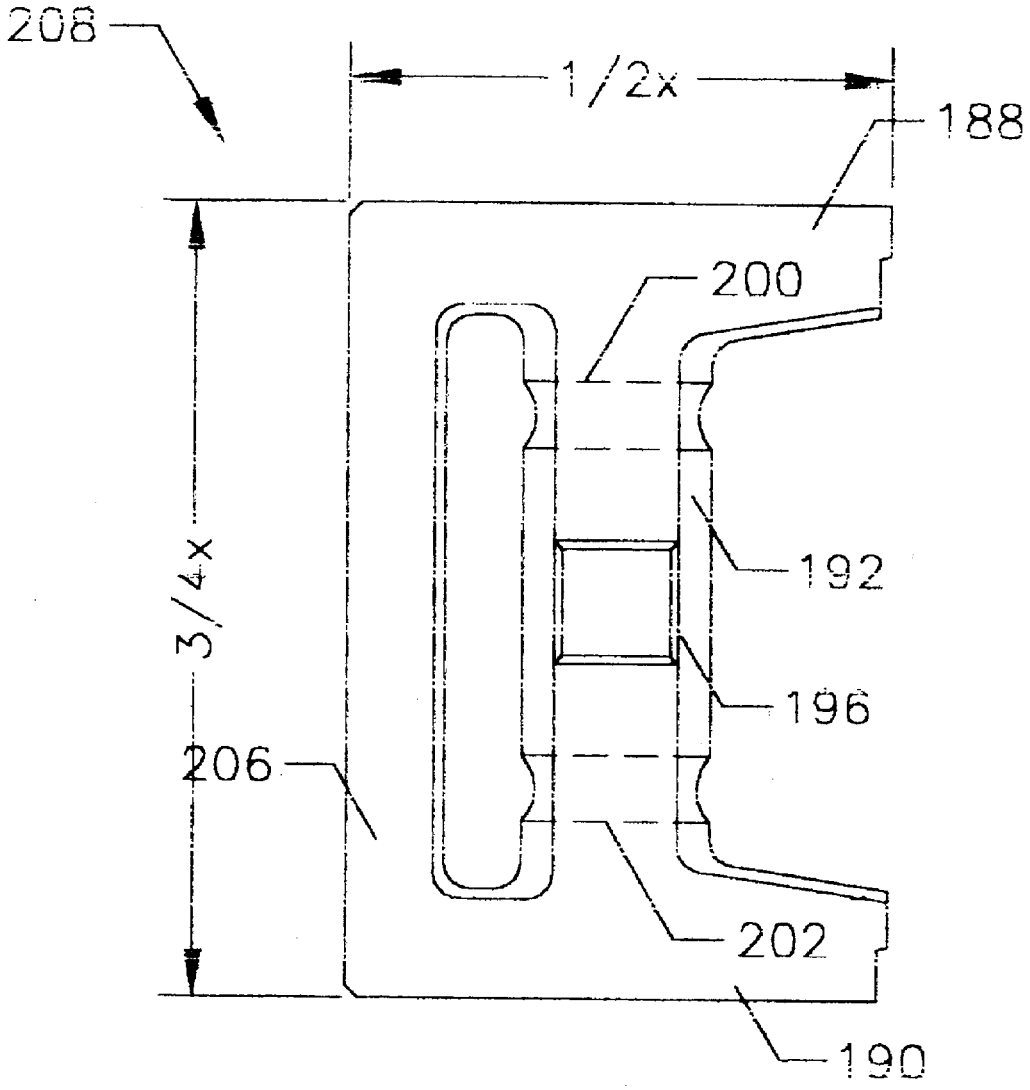
FIG. 42 is a top plan view showing a second variant of the block of FIG. 38 having a nominal predetermined length ½ x.

A half-block 208 is shown for completeness in FIG. 42 and like numerals to FIGS. 38 and 41 are used to identify like parts.

The block set is completed by a pair of transition blocks used in the construction of corners, and T-walls and also to accommodate blocks of narrower widths in a transverse course.

Figure 43:
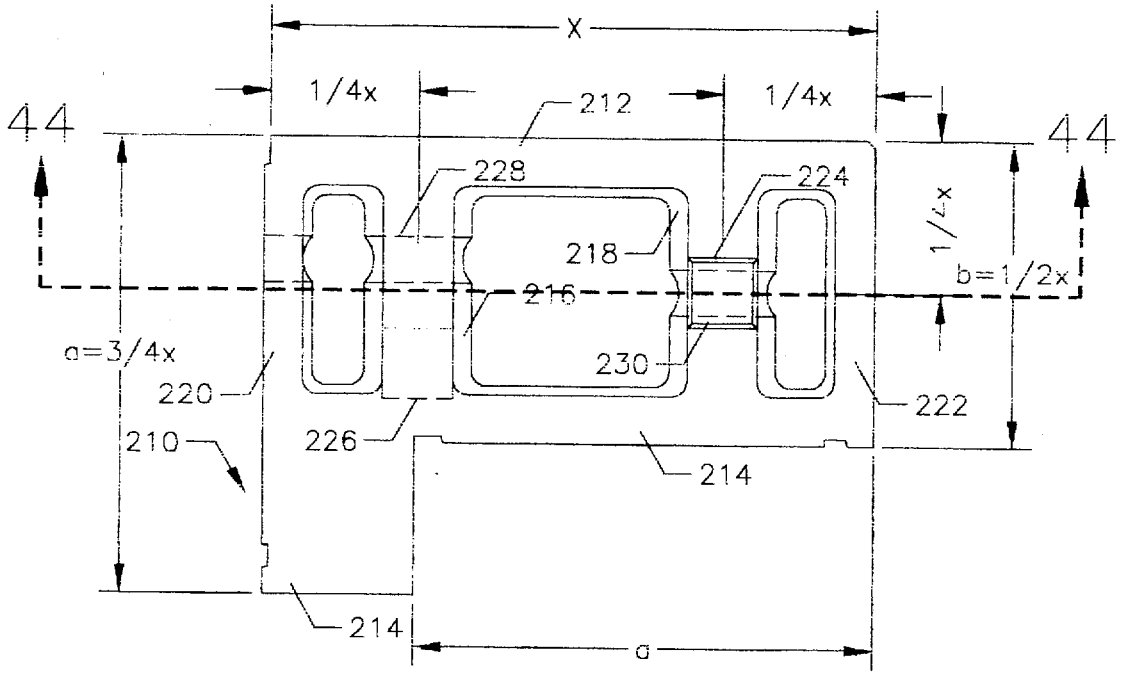
FIG. 43 is a top plan view of a third variant of the block of FIG. 38 comprising a right-corner transition block.

A right corner transition block 210 is drawn in FIG. 43 and has a width "a" equal to ¾ x at one end of the block. Where x corresponds to one modular length unit of 400 mm. The width "a" is equal to 300 mm. The other end of the block is narrower and has a width "b" which is less than "a", in this case, 200 mm, and the narrow end of width "b" has a length of "a" or 300 mm.

Thus, the block 210 has a planar outer shell 212 which is spaced from, and parallel to, an inner shell 214 which is stepped to form a corner. The inner and outer shells 214, 212 are joined by a pair of parallel bridge portions 216, 218, both inwardly spaced at their mid-point from the ends of the face shells by a distance ¼ x. Both ends of the block are closed by respective end portions 220, 222 disposed transversely to the face shells 212, 214.

Figure 44:
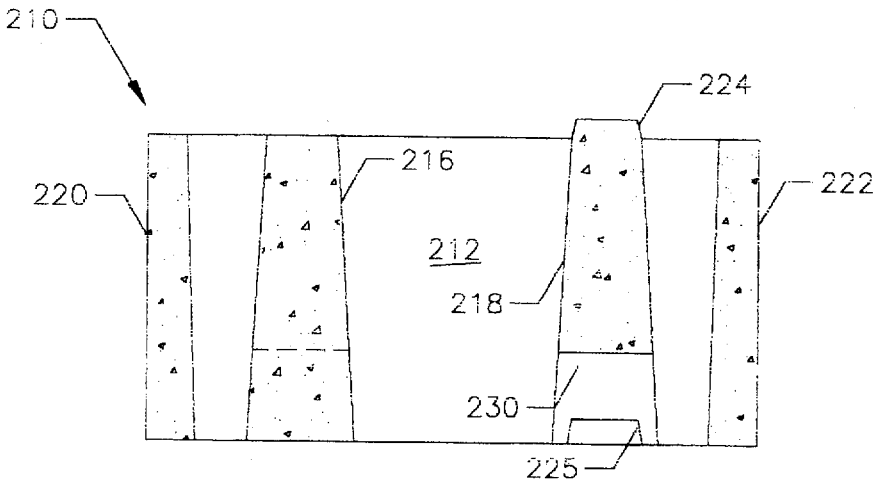
FIG. 44 is a cross-sectional view taken on line 44—44 of FIG. 43.

At least one projection is formed in the bridge portions 216, 218 of a transition block. In FIG. 43, a single projection 224 is formed adjacent the narrow end of the block 210 having a width "b" of 200 mm. The projection 224 is disposed at a distance ¼ x of 100 mm from the associated end portion 222 and is midway between the outer face shell 212 and inner face shell 214 at that end, so that it is likewise at a distance ¼ x of 100 mm from the planar outer face shells 212. A corresponding recess formed to receive a projection of an underlying transition block is indicated in FIG. 44 by reference numeral 225.

A pair of transversely-staggered grooves 228, 230 are formed in the underside of the block 210 to accommodate a reinforcement bar (not shown).

Figure 45:
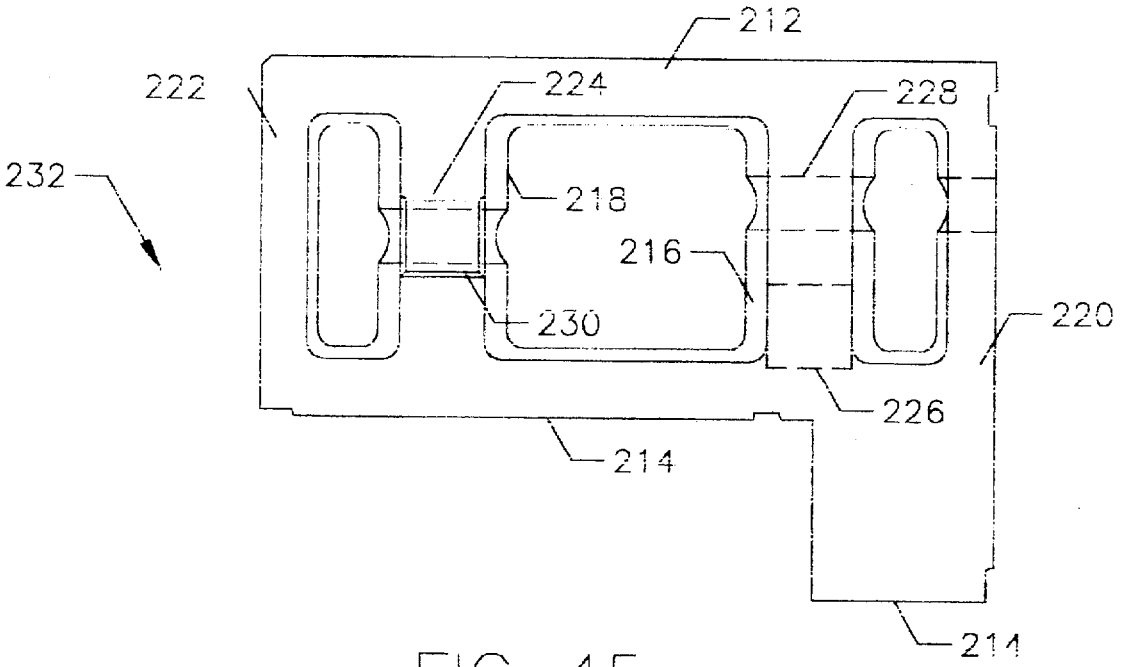
FIG. 45 is a top plan view of a fourth variant of the block of FIG. 38 comprising a left-corner transition block.

A left-corner transition block 232 is shown in FIG. 45 and is similar in all respects to the right corner transition block 210, except that it is a mirror image thereof when seen in plan. Like parts have been indicated by like reference numerals in FIGS. 43 and 45.

Figure 46:
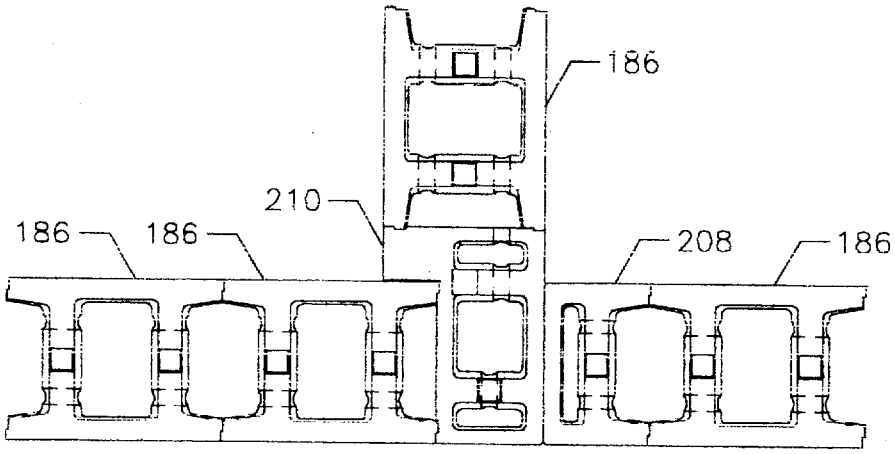
FIG. 46 is a schematic plan view from the top of a first course of blocks forming a T-wall.
Figure 47:
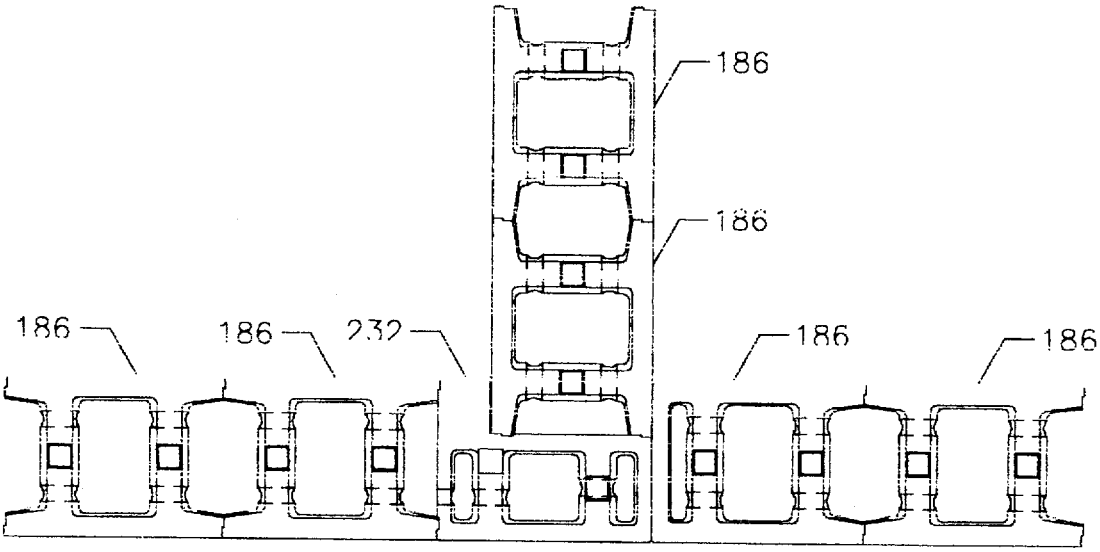
FIG. 47 is a schematic plan view from the top of a second course of blocks disposed over the blocks of FIG. 46.
Figure 48:
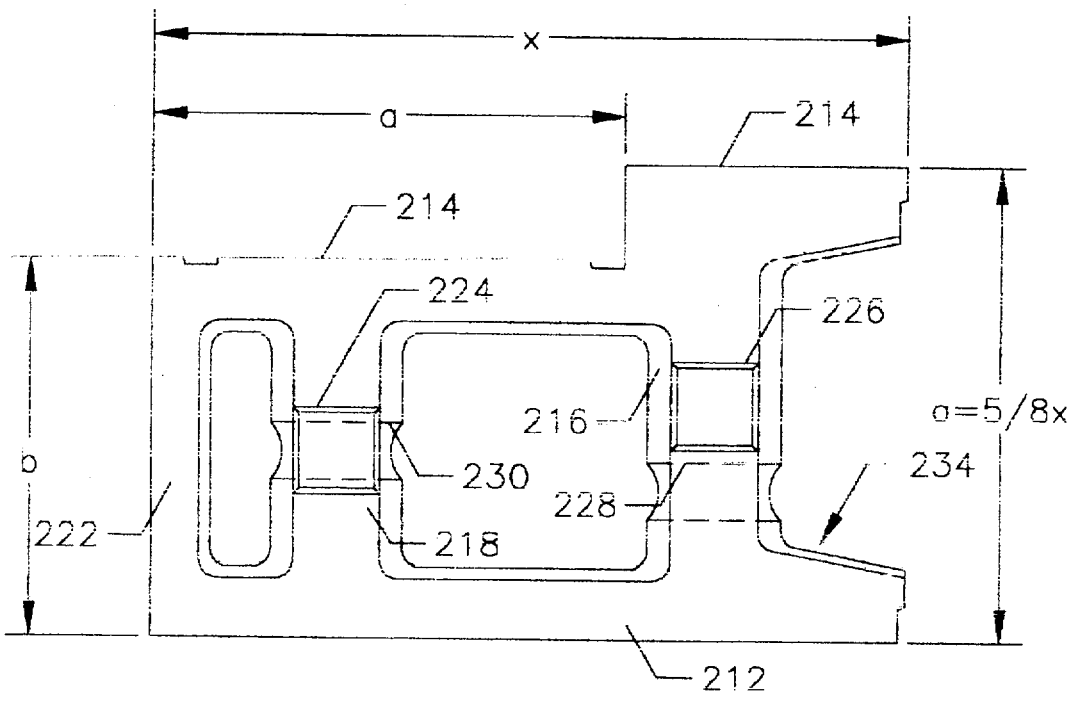
FIG. 48 is a top plan view of a block having a nominal predetermined length x and a width ⅝ x comprising a right-corner transition block.
Figure 49:
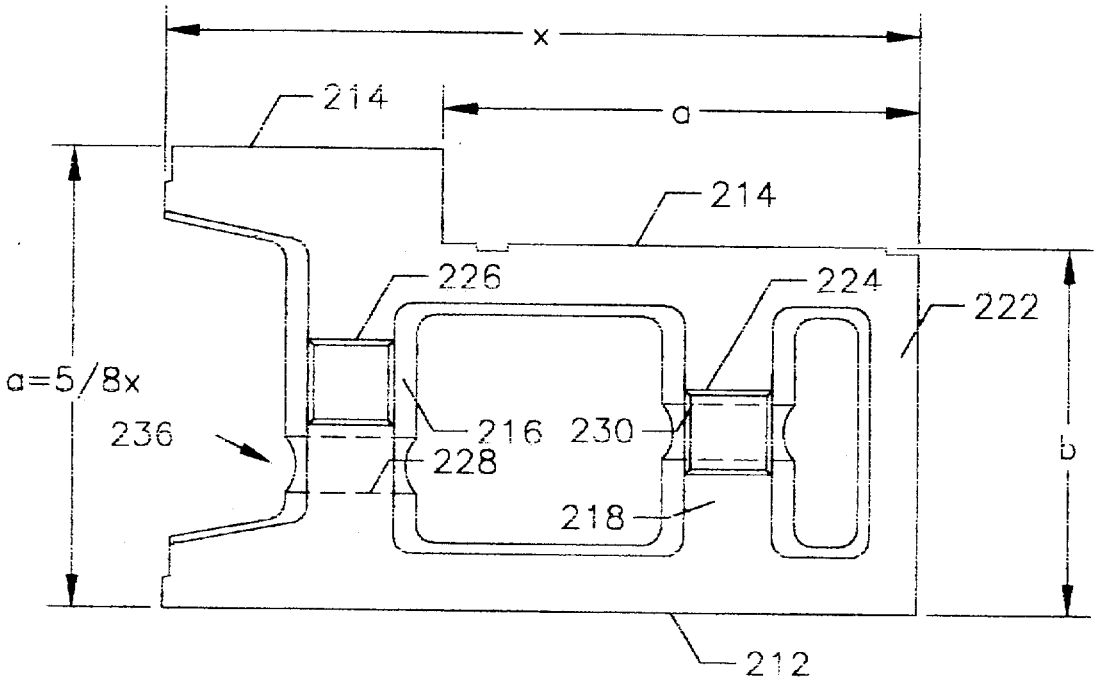
FIG. 49 is a top plan view of a block having a nominal predetermined length x and a width ⅝ x comprising a left-corner transition block.

A double course repeat comprising left and right corner transition blocks 232, 210, full blocks 186, and half-blocks 208 combined to form a T-wall is shown in FIGS. 46 and 47.

Where "a" is sufficiently narrow, for example, equal to 250 mm or ⅝ x, a second projection 226 can be accommodated between the outer and inner face shells 212, 214 and provided at a distance of "½ a" or 125 mm from the planar outer face shell 212. Such 250 mm transition blocks are shown in FIGS. 48 and 49, the block 234 of FIG. 48 being a right corner transition block and the block 236 of FIG. 50 being a left corner transition block. These blocks have no end walls 220 at the wide end but otherwise are similar to the blocks 210, 232 of FIGS. 43 and 45. As indicated by the ghost outline position of a postulated projection 226 in the 300 mm blocks of FIGS. 43 and 45, an overlying block could not cooperate with such a projection without interfering with a transverse block.

In all of the above-described blocks, the projections on a bridge portion have been shown as a single formation having a square cross-section. It will be understood that other cross-sections may be used, provided they will nest in the corresponding recess when rotated by 90°. It will also be understood that the projections may be defined by a set of a plurality of formations which will nest in the corresponding recesses when rotated by 90°. The variations are limitless, as will be understood by those skilled in the art.

Figure 50:
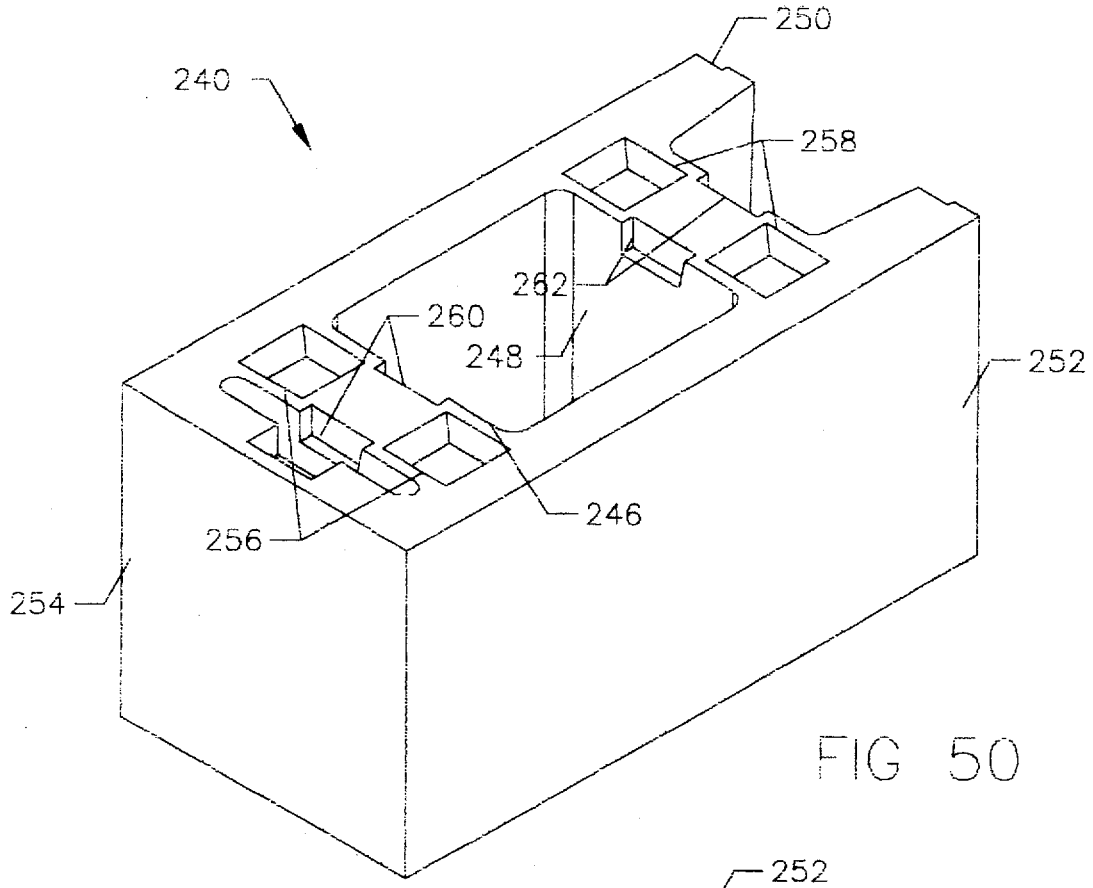
FIG. 50 is a perspective view from the bottom of a full-end block having a nominal predetermined length x and a width ⅜ x, and having two pairs of projections, in accordance with the invention.
Figure 51:
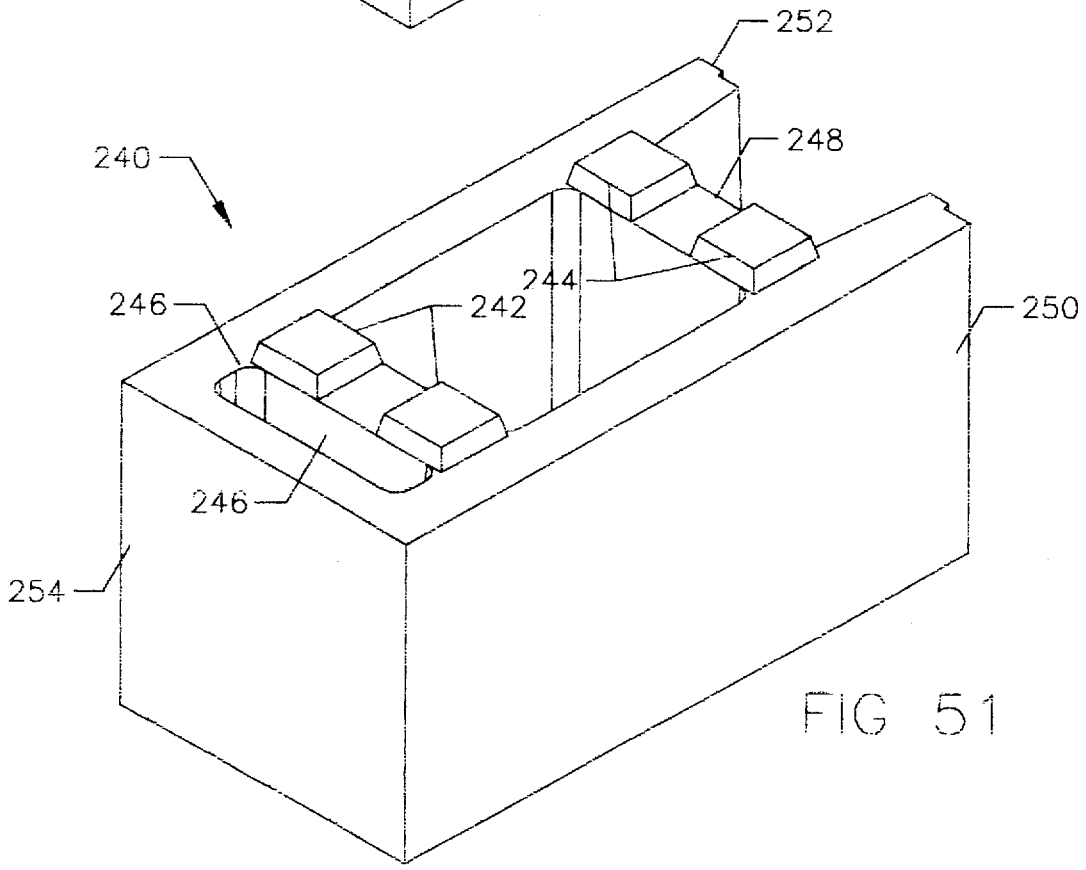
FIG. 51 is a perspective view from the top of the block of FIG. 50.
Figure 52:
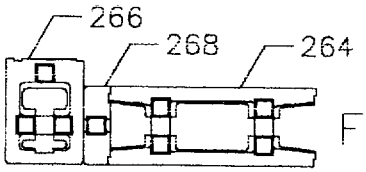
FIG. 52 is a schematic plan view from the top of a first course of blocks forming an L-corner.
Figure 53:
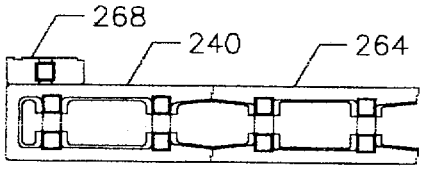
FIG. 53 is a schematic plan view from the top of a second course of blocks disposed over the blocks of FIG. 52.
Figure 54:
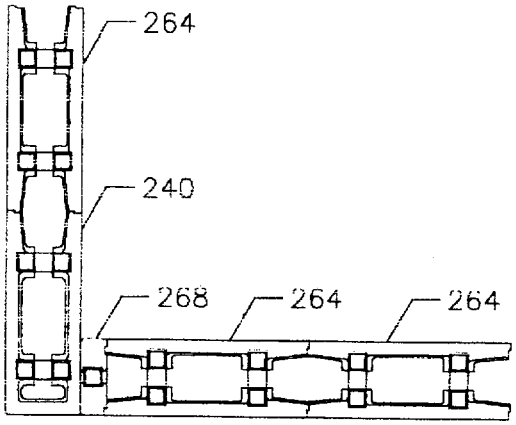
FIG. 54 is a schematic plan view from the top of a first course of blocks forming a corner.
Figure 55:
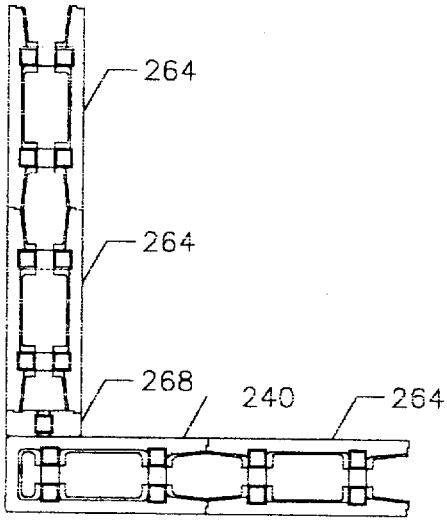
FIG. 55 is a schematic plan view from the top of a second course of blocks disposed over the blocks of FIG. 54.
Figure 56:
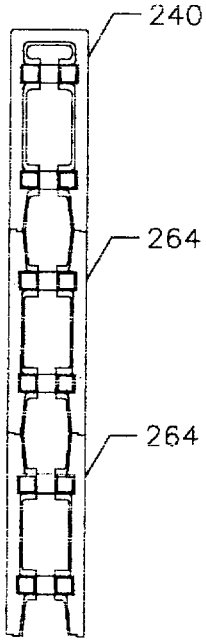
FIG. 56 is a schematic plan view from the top of a first course of blocks disposed end to end.
Figure 57:
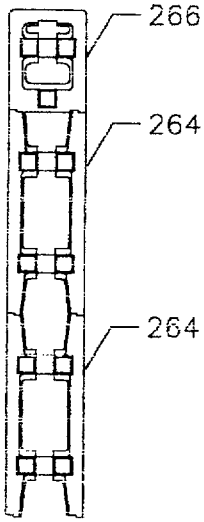
FIG. 57 is a schematic plan view from the top of a second course of blocks disposed over the blocks of FIG. 56.

An exemplary full end-block 240 drawn in FIGS. 50 and 51 embodying the invention and having a pair of projections 242, 244 on respective bridge portions 246, 248 is included to show one such variation in which each pair of projections comprises a set. The bridge portions 246, 248 extend between an outer face shell 250 and an inner face shell 252 and are inwardly-spaced from the ends of the face shells by a distance ¼ x where x is the length of the block. The separation between the exterior surfaces of the face shells is ⅜ x, corresponding to a block width of 150 mm for a length x equal to 400 mm. Detail of the end profile for the face shells has been omitted for simplicity. At one end of the block 240, to the left as drawn in FIGS. 50, 51, a transverse end portion 254 joins the outer and inner face shells 250, 252.

It will be seen in the drawings that each pair of projections 242, 244 is disposed on a top surface of a respective bridge portion 246, 248 to be equally-spaced from a longitudinal axis for the block, each projection of a pair being adjacent to a respective face shell 250, 252.

Corresponding pairs of recesses 256, 258 are formed on a bottom surface of a respective bridge portion 246, 248 and are adapted to receive the associated projections 242, 244 of an overlying block. The full-end block 240 shown in the drawings will typically be used to form corner applications and end walls as shown schematically in FIGS. 52–57. In order to receive an underlying block disposed transversely, additional recesses in the form of notch pairs 260, 262 are formed on the bottom surface of respective bridge portions 246, 248 and are centered on the longitudinal axis of the block. Together with the recesses 256, 258, the notch pairs 260, 262 form a cruciform shape which is centered on the associated bridge portions 246, 248.

In the application drawings of FIGS. 52–57, the full-end block 240 is associated with standard blocks identified by numeral 264, half-blocks 266, and filler blocks 268 required to provide a modular complement as described above with reference to FIGS. 26–29.

It will be appreciated that still more variations may be made to the above-described embodiment of the invention, as will be apparent to those skilled in the art.

I claim:

1. An interlocking building block for use in constructing mortarless walls, the building block having an outer face shell in spaced parallel relationship with an inner face shell, the outer and inner face shells each having a nominal predetermined length x between respective ends where x corresponds to one modular length unit and a predetermined height;

a pair of transversely disposed bridge portions having a predetermined length and a width extending between said outer and inner face shells, said bridge portions being inwardly spaced from the ends of said face shells;

at least one projection integrally formed in an operatively upper surface of each bridge portion to extend above the height of the associated face shells;

at least one corresponding recess integrally formed on an operatively lower surface of each bridge portion and adapted to receive a corresponding number of projections of an underlying block; and at least one groove extending upwardly through the operatively lower surface of each bridge portion and traversing the length of each bridge portion, each said at least one groove being adapted to accommodate a reinforcement bar of indefinite length traversing the length of the block.

2. Building block according to claim 1 in which at least one end of the block between the said inner and outer face shells is closed by a transverse end portion.

3. Building block according to claim 1 in which both bridge portions are equidistant from respective ends of said face shells and a respective one of said projections is spaced from a respective end of said face shells by a distance ¼ x.

4. Building block according to claim 1 in which there is a single groove traversing each bridge portion, the groove extending upwardly through a respective recess in the bridge portion.

5. Building block according to claim 1 in which the operatively upper surface of each bridge portion is notched to locate a tie-wire for supporting a reinforcement bar disposed in the associated groove.

6. An interlocking building block for use in constructing mortarless walls, the building block having an outer face shell in spaced parallel relationship with an inner face shell each having a predetermined length between respective ends defining a length for the block and a predetermined height;

at least one transversely-disposed bridge portion having a predetermined length and a width extending between said outer and inner face shells, said bridge portion being inwardly spaced from the ends of said face shells;

at least one projection integrally formed in an operatively upper surface of said at least one bridge portion to extend above the height of the associated face shells;

at least one corresponding recess integrally formed on an operatively lower surface of said at least one bridge portion and adapted to receive a corresponding number of projections of an underlying block; and at least one groove extending upwardly through the operatively lower surface of said at least one bridge portion and traversing the length of said at least one bridge portion, each said at least one groove being adapted to accommodate a reinforcement bar of indefinite length traversing the length of the block.

7. Building block according to claim 6 in which there is a single groove traversing said at least one bridge portion, the groove extending upwardly through a respective one of said recesses in said at least one bridge portion.

8. Building block according to claim 6 in which the operatively upper surface of said at least one bridge portion is notched to locate a tie-wire for supporting a reinforcement bar disposed in the associated groove.

9. Building block according to claim 6 in which said ends of said face shells each having an L-shaped profile, said L-shaped profile of the outer face shell and the inner face shell having the same orientation at respective ends of the block and having a complementary orientation at opposite ends of the block, the ends thus being adapted to cooperate with ends of adjacent blocks of which the outer face shells and inner face shells may be disposed on either side of a wall being constructed.

10. Building block according to claim 6 in which said inner face shell is spaced from said outer face shell on the operatively lower surface of the block by a distance which is commensurate with said at least one projection so that the projection of an underlying block may be accommodated in a cavity defined between said inner and outer face shells, and located by said face shells.

11. Building block according to claim 6 in which at least one end of the block between inner and outer face shells is closed by a transverse end portion.

12. Building block according to claim 6 in which the outer and inner face shells each having a nominal predetermined length x between respective ends where x corresponds to one modular length unit;

said at least one bridge portion being located so that a respective one of said projections is spaced from a respective end of said face shells by a distance ¼ x.

13. Building block according to claim 6 in which the outer and inner face shells each having a nominal predetermined length ¾ x between respective ends where x corresponds to one modular length unit;

said at least one bridge portion being located so that a respective one of said projections is spaced from a respective end of said face shells by a distance ¼ x.

14. Building block according to claim 6 in which the outer and inner face shells each having a nominal predetermined length ½ x between respective ends where x corresponds to one modular length unit;

said at least one bridge portion being located so that a respective one of said projections is spaced from a respective end of said face shells by a distance ⅛ x.

15. Building block according to claim 6 in which the outer and inner face shells each having a nominal predetermined length x between respective ends where x corresponds to one modular length unit;

said at least one bridge portion being located so that a respective one of said projections is spaced from a respective end of said face shells by a distance ¼ x, said other of said ends of said face shells being joined by a transverse end portion.

16. Building block according to claim 6 in which the outer and inner face shells each having a nominal predetermined length ½ x between respective ends and a width of the block defined between exterior surfaces of said face shells is ⅜ x where x corresponds to one modular length unit;

said at least one bridge portion being located so that a respective one of said projections is spaced from a respective end of said face shells by a distance 1/16 x, said other of said ends of said face shells being joined by a transverse end portion.

17. An interlocking building block for use in constructing mortarless walls, the building block having an outer face shell in spaced parallel relationship with an inner face shell, the outer and inner face shells each having a nominal predetermined length x between respective ends where x corresponds to one modular length unit and a predetermined height;

a pair of transversely disposed bridge portions having a predetermined length and a width extending between said outer and inner face shells, said bridge portions being inwardly spaced from the ends of said face shells;

at least one projection integrally formed in an operatively upper surface of each bridge portion to extend above the height of the associated face shells;

at least one corresponding recess integrally formed on an operatively lower surface of each bridge portion and adapted to receive a corresponding number of projections of an underlying block;

at least one groove extending upwardly through the operatively lower surface of each bridge portion and traversing the length of each bridge portion, each said at least one groove being adapted to accommodate a reinforcement bar of indefinite length traversing the length of the block; and in which the operatively upper surface of each bridge portion is notched to locate a tie-wire for supporting a reinforcement bar disposed in the associated groove.

18. An interlocking building block for use in constructing mortarless walls, the building block having an outer face shell in spaced parallel relationship with an inner face shell each having a predetermined length between respective ends defining a length for the block and a predetermined height;

at least one transversely-disposed bridge portion having a predetermined length and a width extending between said outer and inner face shells, said bridge portion being inwardly spaced from the ends of said face shells;

at least one projection integrally formed in an operatively upper surface of said at least one bridge portion to extend above the height of the associated face shells;

at least one corresponding recess integrally formed on an operatively lower surface of said at least one bridge portion and adapted to receive a corresponding number of projections of an underlying block;

at least one groove extending upwardly through the operatively lower surface of said at least one bridge portion and traversing the length of said at least one bridge portion, each said at least one groove being adapted to accommodate a reinforcement bar of indefinite length traversing the length of the block;

and in which the operatively upper surface of said at least one bridge portion is notched to locate a tie-wire for supporting a reinforcement bar disposed in the associated groove.

19. An interlocking building block for use in constructing mortarless walls, the building block having an outer face shell in spaced parallel relationship with an inner face shell each having a predetermined length between respective ends defining a length for the block and a predetermined height;

at least one transversely-disposed bridge portion having a predetermined length and a width extending between said outer and inner face shells, said bridge portion being inwardly spaced from the ends of said face shells;

at least one projection integrally formed in an operatively upper surface of said at least one bridge portion to extend above the height of the associated face shells;

at least one corresponding recess integrally formed on an operatively lower surface of said at least one bridge portion and adapted to receive a corresponding number of projections of an underlying block;

at least one groove extending upwardly through the operatively lower surface of said at least one bridge portion and traversing the length of said at least one bridge portion, each said at least one groove being adapted to accommodate a reinforcement bar of indefinite length traversing the length of the block;

the ends of said face shells each having an L-shaped profile, said L-shaped profile of the outer face shell and the inner face shell having the same orientation at respective ends of the block and having a complementary orientation at opposite ends of the block, the ends thus being adapted to cooperate with ends of adjacent blocks of which the outer face shells and inner face shells may be disposed on either side of a wall being constructed.

20. An interlocking building block for use in constructing mortarless walls, the building block having an outer face shell in spaced parallel relationship with an inner face shell each having a predetermined length between respective ends defining a length for the block and a predetermined height;

at least one transversely-disposed bridge portion having a predetermined length and a width extending between said outer and inner face shells;

at least one projection integrally formed in an operatively upper surface of said at least one bridge portion to extend above the height of the associated face shells;

at least one corresponding recess integrally formed on an operatively lower surface of said at least one bridge portion and adapted to receive a corresponding number of projections of an underlying block;

said ends of said face shells each having an L-shaped profile at one end of the block, said L-shaped profile of the outer face shell and the inner face shell having the same orientation.

* * * * *